US012295429B2

(12) United States Patent
Morgan

(10) Patent No.: US 12,295,429 B2
(45) Date of Patent: May 13, 2025

(54) GARMENT WITH CLOSURE

(71) Applicant: Mollusca Atelier LLC, Atlanta, GA (US)

(72) Inventor: Toby K. L. Morgan, Atlanta, GA (US)

(73) Assignee: Mollusca Atelier LLC

( * ) Notice: Subject to any disclaimer, the term of this patent is extended or adjusted under 35 U.S.C. 154(b) by 0 days.

(21) Appl. No.: 18/521,340

(22) Filed: Nov. 28, 2023

(65) Prior Publication Data

US 2024/0090592 A1 Mar. 21, 2024

Related U.S. Application Data

(62) Division of application No. 17/682,597, filed on Feb. 28, 2022, now abandoned.

(Continued)

(51) Int. Cl.
*A41B 9/00* (2006.01)
*A41D 7/00* (2006.01)

(Continued)

(52) U.S. Cl.
CPC ..... *A41B 9/005* (2013.01); *A41D 7/00* (2013.01); *A41D 13/0017* (2013.01);

(Continued)

(58) Field of Classification Search
CPC ..... H01F 27/25

(Continued)

(56) References Cited

U.S. PATENT DOCUMENTS 1,083,712 A 1/1914 Uyeda
2,258,502 A 10/1941 Perez (Continued)

FOREIGN PATENT DOCUMENTS

| | | |
|---|---|---|
| CN | 306416171 | 3/2021 |
| EP | 3143885 | 3/2017 |
| WO | 2014164411 | 10/2014 |

OTHER PUBLICATIONS

Crabbe, George; "Using Magnets to Attach Your Race Number"; Aug. 13, 2020; First 4 Magnets https://www.first4magnets.com/us/applications/using-magnets-to-attach-your-race-number/ (Year: 2020).*

(Continued)

*Primary Examiner* — Jocelyn Bravo
(74) *Attorney, Agent, or Firm* — Meunier Carlin & Curfman LLC

(57) ABSTRACT

The disclosure relates to a garment comprising a lower torso portion comprising a front portion, a back portion, and a strap portion configured to couple the back portion and the front portion. The strap portion is fixed to one of the back portion or the front portion at one end thereof and free at the other end thereof, and the free end is configured for being removably coupled to the other of the front portion or back portion. The strap portion is configured for being circumferentially disposed over the pubis mound and between legs of the user. The strap portion comprises a first magnetic closure coupled to the free end thereof and the other of the front portion or back portion to which the strap portion is removably coupled comprises a second magnetic closure.

14 Claims, 49 Drawing Sheets

Related U.S. Application Data

(60) Provisional application No. 63/283,153, filed on Nov. 24, 2021, provisional application No. 63/154,578, filed on Feb. 26, 2021.

(51) Int. Cl.
*A41D 13/00* (2006.01)
*A41F 1/00* (2006.01)

(52) U.S. Cl.
CPC ..... *A41F 1/002* (2013.01); *A41B 2300/30* (2013.01); *A41D 2300/30* (2013.01)

(58) Field of Classification Search
USPC ..... 335/306; 24/303
See application file for complete search history.

(56) References Cited

U.S. PATENT DOCUMENTS

| | | | | |
|---|---|---|---|---|
| 2,319,292 | A | 5/1943 | Henry | |
| 2,548,660 | A | 4/1951 | Feldman | |
| 2,617,101 | A | 11/1952 | Weintraub | |
| 2,638,900 | A | 5/1953 | Gruenberg | |
| 2,661,002 | A | 12/1953 | Silverman | |
| 2,747,391 | A | 5/1956 | Burkey | |
| 3,140,718 | A | 7/1964 | Farkas | |
| 3,161,932 | A | 12/1964 | Russell | |
| 3,279,469 | A | 10/1966 | Schustack | |
| 3,503,405 | A | 3/1970 | Porco | |
| 3,827,019 | A | 7/1974 | Serbu | |
| 3,974,836 | A | 8/1976 | Carlson | |
| 4,597,110 | A | 7/1986 | Smith, Sr. | |
| 4,637,078 | A * | 1/1987 | Southwell | A61F 5/44 2/408 |
| 4,835,795 | A | 6/1989 | Lonon | |
| 4,961,234 | A | 10/1990 | Leibman | |
| 5,086,519 | A | 2/1992 | Rokasky | |
| 6,050,931 | A | 4/2000 | Russell | |
| 6,243,871 | B1 | 6/2001 | Fidler | |
| 6,301,754 | B1 | 10/2001 | Grunberger | |
| 6,324,699 | B1 | 12/2001 | Cosmah | |
| 6,412,116 | B1 | 7/2002 | Clark | |
| 6,412,119 | B1 | 7/2002 | Robles | |
| 7,032,249 | B2 | 4/2006 | Smith | |
| D595,030 | S | 6/2009 | Spellman | |
| D603,582 | S | 11/2009 | Fennell | |
| D648,098 | S | 11/2011 | Mitchell | |
| 8,555,422 | B2 | 10/2013 | Steele | |
| 8,695,194 | B2 | 4/2014 | Kress | |
| 9,089,173 | B2 | 7/2015 | Krishnan | |
| 9,721,712 | B2 | 8/2017 | Provencher | |
| 9,750,287 | B2 | 9/2017 | Cohen Larren | |
| 9,966,174 | B2 | 5/2018 | Naftali | |
| D827,980 | S | 9/2018 | Slater | |
| 10,433,592 | B2 | 10/2019 | Olshansky | |
| 10,709,177 | B2 | 7/2020 | Shoemaker | |
| 10,779,592 | B2 | 9/2020 | Horton | |
| 10,856,594 | B2 | 12/2020 | Smith, IV | |
| 11,270,823 | B2 | 3/2022 | Naftali | |
| 11,357,265 | B2 | 6/2022 | Hanson Allen | |
| D958,490 | S | 7/2022 | Pal | |
| D969,452 | S | 11/2022 | Miles | |
| 11,517,055 | B1 | 12/2022 | Cristiano | |
| 11,598,146 | B2 | 3/2023 | Conboy | |
| 2002/0178551 | A1 | 12/2002 | Hsu | |
| 2006/0006969 | A1 | 1/2006 | Cassar | |
| 2006/0277649 | A1 | 12/2006 | Smith | |
| 2009/0118574 | A1 | 5/2009 | Stephenson | |
| 2009/0178245 | A1 | 7/2009 | Albert | |
| 2009/0320184 | A1 | 12/2009 | Schaefer | |
| 2011/0016604 | A1 | 1/2011 | Lim | |
| 2013/0061431 | A1 | 3/2013 | Naftali | |
| 2014/0259266 | A1 | 9/2014 | Federlin | |
| 2016/0143373 | A1 | 5/2016 | Castellano | |
| 2016/0307680 | A1 | 10/2016 | Provencher | |
| 2017/0119066 | A1 | 5/2017 | Robinson | |
| 2018/0228665 | A1 | 8/2018 | Relekar | |
| 2019/0075869 | A1 * | 3/2019 | Smith, IV | A45C 3/00 |
| 2019/0110527 | A1 | 4/2019 | Ghasletwala | |
| 2020/0345079 | A1 * | 11/2020 | Giangaspro | A41B 13/08 |
| 2021/0052059 | A1 * | 2/2021 | McMillan, II | H04B 1/3888 |
| 2021/0076751 | A1 | 3/2021 | Dubose | |
| 2021/0204627 | A1 * | 7/2021 | Linchitz | A41D 3/005 |
| 2022/0211121 | A1 | 7/2022 | Tennessee | |
| 2022/0273048 | A1 | 9/2022 | Morgan | |
| 2022/0386723 | A1 | 12/2022 | Back | |

OTHER PUBLICATIONS

Petals Panties Product Information, Lady Hike Products, 4 pages, accessed on Jun. 16, 2022, at https://www.ladyhike.com/products/petals-pantease-black-satin-woven-waistband.

Shein Unity Solid Cami Bodysuit. SKU: swbodysui07190705527. Available online at. https://www.shein.com.mx/SHEIN-Unity-Solid-Cheeky-Cami-Bodysuit-p-787185-cat-1882.html?src_identifier=st%3D2%60sc%3Dunity%20body%20casual%20mangas%60sr%3D0%60psoSTINAL%3Dl&src_module=search&src_tab_page_id=page_search1677861265551&mallCode=1.

SHEIN EZwear Body unicolor tejido de canalé. SKU: sw2107132912538242 Aug. 21, 2021. Available online at: https://www.shein.com.mx/SHEIN-Solid-Ribbed-Knit-Bodysuit-p-3560621-cat-1882.html?mallCode=1.

Breathable Bodysuit Women Long Sleeves Trim Body Shapewear Lingerie Hooks Basic Tummy Control Clothing. Publication Date: Aug. 11, 2020. Published online at: https://www.amazon.ca/Breathable-Bodysuit-Shapewear-Lingerie-Clothing/dp/B08DL9WQJX. Manufactured by Sivane and listed on Amazon.ca.

United Kingdom Design Registration No. 6132060 to Alicia Amber Hassan. Filed Apr. 20, 2021. Registered Apr. 20, 2021.

Croatian Registered Design No. M990072 to Borkica Pavec. Filed Apr. 8, 1999. Application published Apr. 30, 2001. Registered Oct. 15, 2001. Registration published Oct. 31, 2001.

Jan. 16, 2023 Notification of Refusal issued by Canadian Intellectual Property Office for Canadian Application No. 209203 based on International Design Registration No. DM/217941.

Mar. 7, 2023 Notification of Total Refusal issued by Mexican Institute of Industrial Property Office for Mexican Application No. MX/f/2022/000674 based on International Design Registration No. DM/217941.

[BODX], posted Aug. 15, 2021 [online], [retrieved Dec. 26, 2023]. Retrieved from internet, https://www.facebook.com/photo/?fbid=264210925610855 (Year: 2021).

[BODX], posted Feb. 6, 2021 [online], [retrieved Dec. 26, 2023]. Retrieved from internet, https://www.facebook.com/photo/?fbid=119691433396139 (Year: 2021).

[Adorna Low Waist Panty-Snap closure], posted date unknown [online], [retrieved Dec. 26, 2023]. Retrieved from internet, https://www.myadorna.com/products/adorna-low-waist-panty-snap-closure-crotch (Year: 2023).

[BODX Lilac Tank Bodysuit], posted date unknown [online], [retrieved Dec. 26, 2023]. Retrieved from internet, https://bodx.com.au/ products/lilac-tank-not-a-basic-b (Year: 2023).

Nebility Womens' Waist Trainer Seamless Shapewear Bodysuit, [online]; [published to the internet on Feb. 15, 2020]; [retrieved from the internet on Aug. 16, 2023]; URL: https://www.amazon.com/Nebility-Bodysuit-Shapewear-Seamless-Jumpsuits/dp/B07ZLNCTGC? ref_=ast_sto_dp&th=1&psc=1. (7 pages). (Year: 2020).

Boys' Adaptive Hooded Adjustable Bodysuit, [online]; [review published to the internet on approximately Aug. 16, 2020]; [retrieved from the internet on Aug. 16, 2023]; URL: https://www.target.com/p/boys-39-adaptive-hooded-adjustable-bodysuit-cat-38-jack-8482-burgundy-I/-/A-79612840?ref = tgt_adv_xsp&AFID=google&fn . . . (7 pages). (Year: 2020).

* cited by examiner

GARMENT WITH CLOSURE

CROSS-REFERENCE TO RELATED APPLICATIONS

This application is a division of and claims priority to U.S. patent application Ser. No. 17/682,597, filed Feb. 28, 2022, which claims priority to provisional U.S. Patent Application No. 63/154,578, filed Feb. 26, 2021, and provisional U.S. Patent Application No. 63/283,153, filed Nov. 24, 2021.

FIELD OF DISCLOSURE

The present disclosure generally relates to garments.

BACKGROUND

Bodysuits are specialty garments desirable in modern fashion trends. These bodysuits are typically secured in the crotch region via a strap emanating from the lower back region a separate strap emanating from the lower front region of the bodysuit, in which the straps connect in the crotch region of one wearing the bodysuit. Thus, the conventional strategy to secure the straps is by using traditional buttons, snap buttons, or hooks located on each strap portion. This often causes problems because the conventional strategy does not consider possible discomfort of having such securing means located in the sensitive area of the body. For example, unwanted friction, poking, and/or overall discomfort may occur when the securing means are in use and flush against the crotch region. Furthermore, existing bodysuits use closures such as buttons, snaps, or hooks that are difficult to fasten and unfasten for many users. Still further, their location on the bodysuits adds to this difficulty and overall maneuverability. Accordingly, there remains a need for a more comfortable, efficient bodysuit. Such an improved bodysuit would preferably have a better location and closing mechanism for both comfort and heightened efficiency during use. This need and other needs are met by various aspects disclosed herein.

BRIEF SUMMARY

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

In one aspect, the present disclosure relates to magnetically securing clothing garment comprising: a trunk or torso portion or garment body configured to be worn over a torso of a user and a strap portion configured to connect a back side and a front side of the torso portion using at least one securing means, and extending from a first location on a first side of the torso portion to a second location on a second side of the torso portion and the strap portion there between being circumferentially disposed over a groin area and between legs of the user. In further aspects, when connected, the strap portion defines first and second lower apertures located between the lower front portion and the lower back portion, each lower aperture configured to accommodate a limb of the user donning the garment.

In another aspect, the present disclosure relates to a magnetically securing clothing garment comprising: a torso portion comprising: a front lower portion, a front upper portion, a back lower portion, and a back upper portion; wherein the torso portion is configured to be worn over a torso; a pair of sleeve portions attached to the torso portion, wherein each sleeve portion is configured to accommodate at least a part of an arm; an aperture located between the lower portion front portion and the lower back portion, wherein the aperture is configured to accommodate at least a part of a pair of legs; a back strap comprising: a first back strap end, and a second back strap end comprising a first securing means, wherein the first back strap end connects to the back lower portion; and a front strap comprising: a first front strap end, and a second front strap end comprising a second securing means, wherein the first front strap end connects to the front lower portion, wherein the first securing means is configured to releasably connect to the second securing means between the legs of a user of the garment.

In another aspect, the present disclosure relates to a magnetically securing clothing garment comprising: a torso portion comprising: a front lower portion, a front upper portion, a back lower portion, and a back upper portion; wherein the torso portion is configured to be worn over a torso; a pair of arm apertures located between the front upper portion and the back upper portion, wherein each arm aperture is configured to accommodate at least a part of an arm; an aperture located between the lower portion front portion and the lower back portion, wherein the aperture is configured to accommodate at least a part of a pair of legs; a back strap comprising: a first back strap end, and a second back strap end comprising a first securing means, wherein the first back strap end connects to the back lower portion; and a front strap comprising: a first front strap end, and a second front strap end comprising a second securing means, wherein the first front strap end connects to the front lower portion, wherein the first securing means is configured to releasably connect to the second securing means between the legs of a user of the garment.

In another aspect, the present disclosure relates to a method for assembling a magnetically securing clothing garment, the method comprising: providing a torso portion comprising: providing a front lower portion, providing a front upper portion, providing a back lower portion, and providing a back upper portion; connecting a first back strap portion of a back strap to the back lower portion, the back strap being substantially longer in length than a front strap; connecting a first front strap portion of a front strap to the lower front portion; connecting a second back strap portion of the back strap embedded with a securing means to a second front strap portion of the front strap embedded with a securing means at the pubic mound area of the user; and covering, when the second back strap portion and the second front portion are connected, the crotch area of a user of the garment via the back strap and the front strap.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings:

FIG. 36 illustrates a plan view and side view of a magnetic strip disposed within each of the pockets defined in the garment shown in FIG. 28.

DETAILED DESCRIPTION

Figure 1:
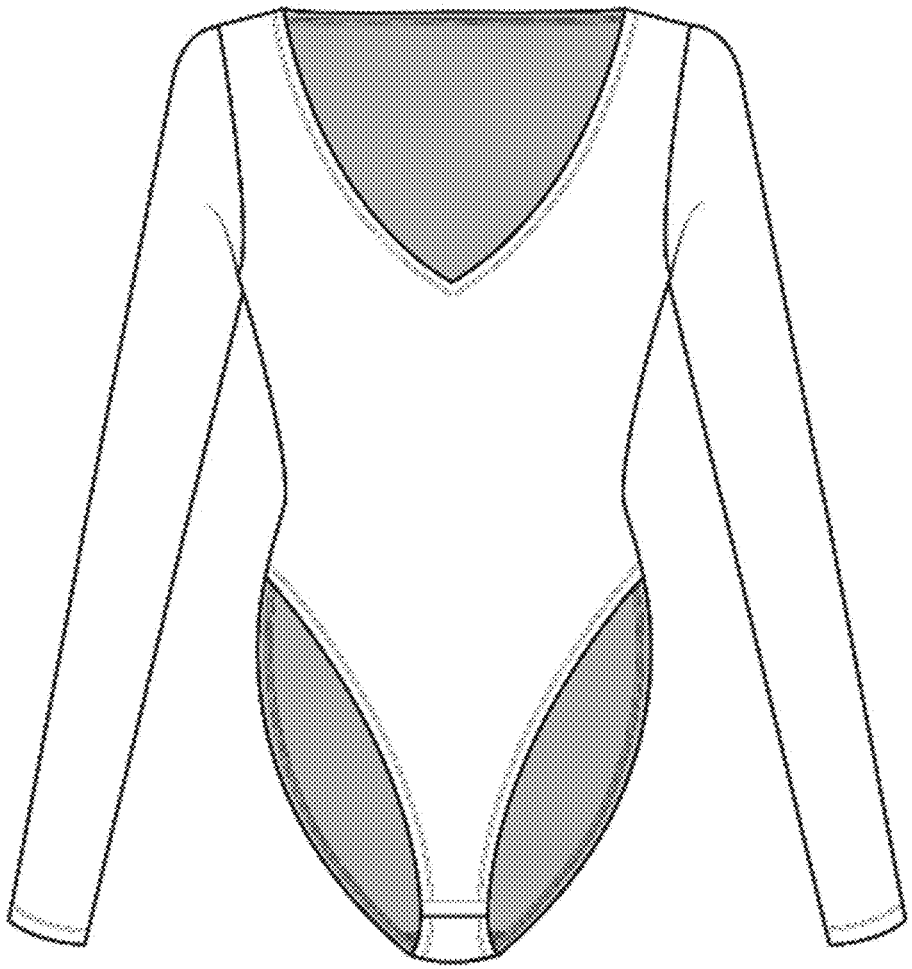
FIG. 1 illustrates a front view of a magnetically securing clothing garment according to an embodiment of the present disclosure.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail. As used in the specification and in the claims, the term "comprising" can include the aspects "consisting of" and "consisting essentially of." In this specification and in the claims, which follow, reference will be made to a number of terms which shall be defined herein.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element. Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed. As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

As used herein, the terms "trunk", "torso", and "torsal" refer to a central part or torso area, such as, for example, an area corresponding to the core of an animal body (including humans) from which extend the neck and limbs. In further aspects, torso may include, without limitation, the thoracic segment of the torso, the abdominal segment of the torso, and/or the perineum.

Disclosed are the materials, components, parts, and/or elements to be used to manufacture the disclosed devices and systems as well as the materials themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices disclosed herein. Thus, if there are a variety of additional steps that can be performed it is understood that each of these additional steps can be performed with any specific aspect or combination of aspects of the methods disclosed herein.

It is understood that the garments, devices and systems disclosed herein have certain functions. Disclosed herein are certain structural features for performing the disclosed functions, and it is understood that there are a variety of structures that can perform the same function that are related to the disclosed structures, and that these structures will typically achieve the same result. Furthermore, the present disclosure may be related to garments (e.g., bodysuits, clothing), devices, apparatuses, systems, and methods for making and using the same.

In addition, although the figures show versions of garments on a feminine body type, it is to be understood that garments according to this disclosure include garments capable of being worn on masculine body types and garments that are not gender specific.

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of garments, embodiments of the present disclosure are not limited to use only in this context.

I. Garment Overview

This overview is provided to introduce a selection of concepts in a simplified form that are further described below. This overview is not intended to identify key features or essential features of the claimed subject matter. Nor is this overview intended to be used to limit the claimed subject matter's scope.

In various aspects, the present disclosure provides to a multi-use garment that may be used by children, adults, and/or newborns that covers at least a portion of the buttocks and the mons pubis of the wearer. For example, the garments may include underpants (e.g., full coverage, partial coverage, thong, shorts, boxer/briefs), shorts, leggings, bodysuits having upper and lower torso portions and no pantlegs, bodysuits having upper and lower torso portions and pantlegs (e.g., short length, capri length, full length, rompers, catsuits), SCUBA diving suits (e.g., wet suit, dry suit), swim suits, diving/surfing shorts, cycling bibs, leotards, ski/snow suits, ski/snow pants, flight suits, space suits, monosuits, athletic wear covering at least the lower torso (e.g., compression shorts or pants), beekeeping suit, personal protective equipment suit, utility pants, overalls, coveralls, jumpsuits, jeans, lingerie, shapewear, sweat pants, and base layers (e.g., long underwear). In some aspects, garments of the present disclosure may be referenced as the "LUSCA" or "LUSCA" garments. Example fabrics include fabrics that include from cotton, polyester, hemp, fiber blends, elastane/spandex (e.g., LYCRA), nylon, neoprene, denim, hosiery, lace, or other suitable fabrics based on the intended use of the garment.

Generally, bodysuits and other garments such as those listed above either have no clasps (e.g., the entire garment must be removed to use the bathroom while wearing the garment) or clasps directly over the crotch area (not visible to the wearer so the person must feel their way through opening and closing the garment). In addition, the clasps are generally very small snap buttons, push buttons or hook and/or eye closures. None of these are easily maneuvered without the ability to see the closure.

This has resulted in users of these garments either just removing the entire garment (leaving the user back at square one) or having the user contort themselves to get in and out of the garment. In general, this can be regularly frustrating for the user. For example, imagine having to remove everything you're wearing in a bathroom stall before using the bathroom each time. This is undesirable.

However, because users enjoy the sleek silhouette a bodysuit provides, for decades users of such bodysuits have conceded with the aforementioned inferior techniques of wearing and disrobing bodysuits. In contrast, the disclosed garments do not force the wearer to remove the entire garment to use the bathroom. The garment can easily be opened and closed making the garment more functional and increasing the usability for both able bodied and disabled wearers.

In various implementations, disclosed herein is a garment created with magnetic clasps and/or magnetic closures with a distinct location on the mons pubis. In a further aspect, the closure and/or clasp may be horizontally oriented, vertically oriented, and/or obliquely oriented relative to a bottom horizontal hem of the lower torso portion and the end of the strap portion. The mechanism and placement of the closure may allow the wearer to release the lower portion of the garment to undress and redress. The placement of the magnets, however, does not compromise its visibility through clothing worn over the garment. The placement of the closure on the mons pubis allows the wearer to see the clasp, increasing visibility and functionality of the closure. Essentially, the wearer can quickly remove the garment without resorting to acrobatics or completely undressing. In a still further aspect, the closure and/or clasp may open upwards or downwards. In a yet further aspect, closures and/or clasps of various embodiments can be operated or otherwise opened using one hand or even one finger even with the use of strong magnets. For example, and without limitation, the user may pull the apex of the triangular shaped (e.g., V-shaped) closure to open. To this end, the user can leverage the clasp body to separate the two parts of the closure.

In various implementations, each magnetic clasp includes a pair of magnet closures that each comprise a plurality of small magnets or a continuous magnetic strip. The magnets may be any suitable magnet having a polarity that is opposite the polarity of the magnets in the opposing closure, and the magnets are arranged on the fabric to align with magnets that have an opposing polarity. The magnets may be coupled directly to the fabric of the garment, to another substrate that is coupled to the fabric of the garment, or disposed within a pocket coupled to the garment. The magnets may or may not be covered by fabric or another material such that they are visible or less visible. Each magnet closure may be in a linear arrangement (e.g., see FIG. 9) or another suitable arrangement relative to the lower hem of the torso portion and the free end of the strap, such as partially triangular (e.g., V-shaped) (e.g., see FIGS. 19-26), rectangular (e.g., see FIGS. 28-35), partially trapezoidal, and semi-circular.

In some implementations, the magnets used for each closure can have a pull strength of at least 100 kg when the pair of closures are coupled together without fabric between the pair of closures. The strength of the closure pair may be decreased when the pair of closures are covered by fabric. The strength of the closure pair can be increased by increasing the number of rectangular magnets arranged in each closure (e.g., increasing the number of magnets for a certain volume, such as by having multiple rows of magnets per closure and/or using smaller magnets). The composition and density of the material of the magnets may also be selected to yield a stronger or weaker pull strength for the pair of closures. The individual magnets in each closure may be arranged with opposing polarities such that a polarity of a first end of the first magnet closure is opposite a second opposite end of the first magnet closure, and the polarity of the first end of the second magnet closure is opposite the polarity of the first end of the first magnet closure and the second end of the second magnet closure. The strength of the closure pair having multiple rectangular magnets as opposed to a continuous magnet strip or larger rectangular magnets having the same volume may be 8 to 10 times stronger.

Even though the multiple rectangular magnets increase the strength of the magnet closures when coupled together, the force needed to intentionally initiate the separation of the closures remains manageably low when the separation is initiated at an end of the pair of closures such that the force applied separates one pair of small opposing magnets at a time for each row of magnets in each closure. This feature allows the wearer to pull the pair of closures apart using one hand by starting at one end of the pair of closures, such as one end of a rectangularly arranged pair of closures or pulling from the apex or ends of triangularly (e.g., V-shaped) arranged closures. Such a feature may be especially useful for able-bodied adult wearers, children wearers, elderly wearers, wearers with reduced mobility, and non-able-bodied wearers. However, magnet closures using continuous strips may also be useful for this variety of wearers since the strength is reduced.

In some implementations, the magnets used for each closure have a life that is at least as long as the expected use of the garment (e.g., 20 years or more) and can withstand exposure to environmental elements and laundering (e.g., resistance to water, snow, sand, detergent, and temperature exposure within −50° C. and 100° C.). In some implementations, the magnets used for each closure are permanent magnets. For example, the magnets may include permanent rare-earth magnets (e.g., Neodymium-Iron-Boron). The permanent magnets may further include an anti-corrosion coating, such as passivated zinc galvanization. Furthermore, in some implementations, the magnets may have a sufficiently low iron content so as to not trigger airport security scanners.

For example, in some implementations, the magnet comprises small rectangular magnets (e.g., 5 millimeters wide each or less) that are arranged so as to be articulatable relative to each other. Therefore, the clasp is not rigid but rather very flexible and pliable, allowing the closures to adapt to the shape of the body of the wearer.

Figure 9:
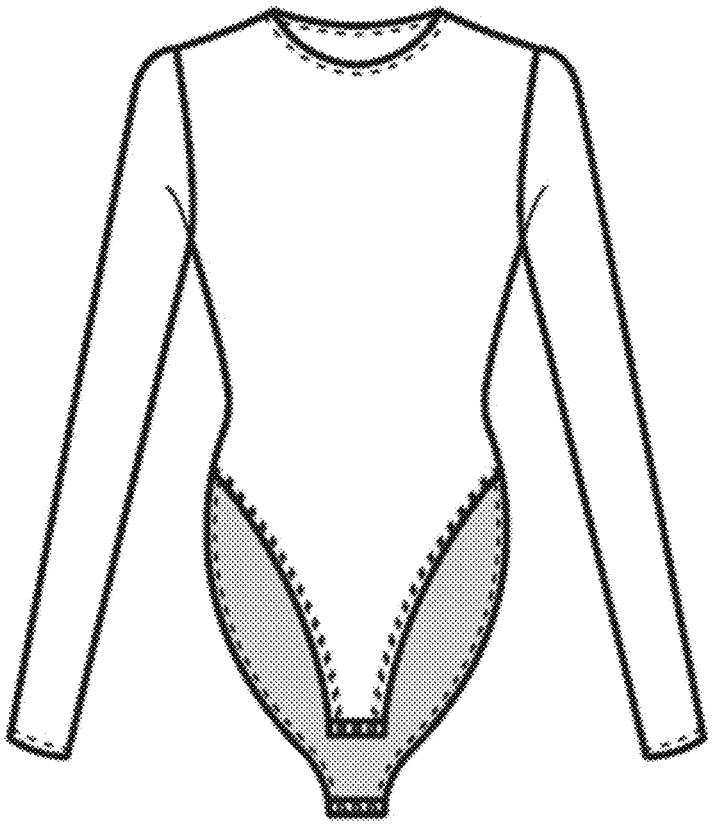
FIG. 9 illustrates a front view of a magnetically securing clothing garment according to another embodiment of the present disclosure.
Figure 10:
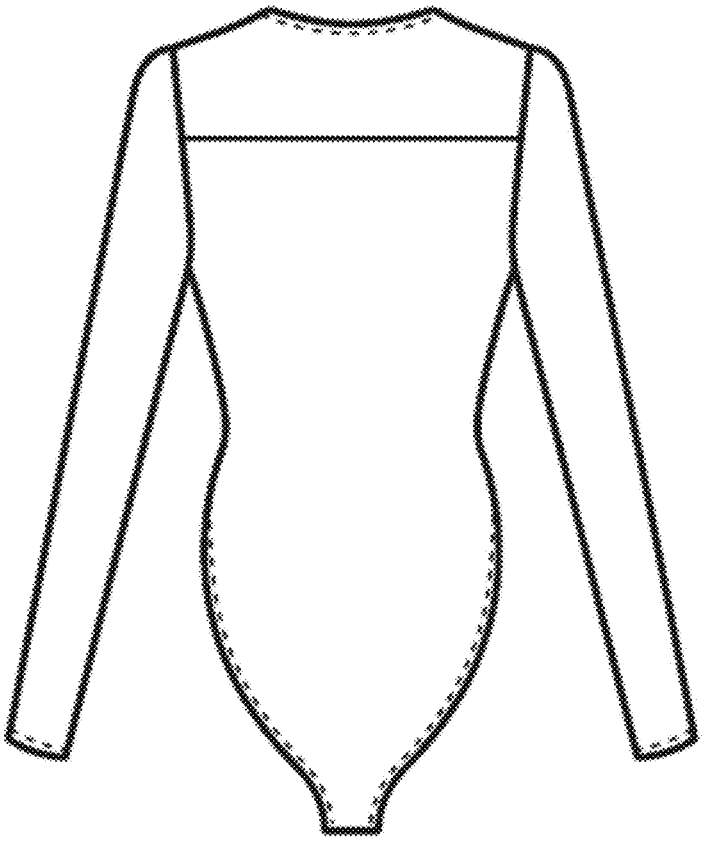
FIG. 10 illustrates a rear view of the magnetically securing clothing garment shown in FIG. 9.

For example, the implementation of the magnet closures shown in FIG. 9 on the free end of the back strap and on the front lower torso portion of the garment each include three magnets that are spaced apart from each other by a width that is greater than a width of each magnet.

Figure 51:
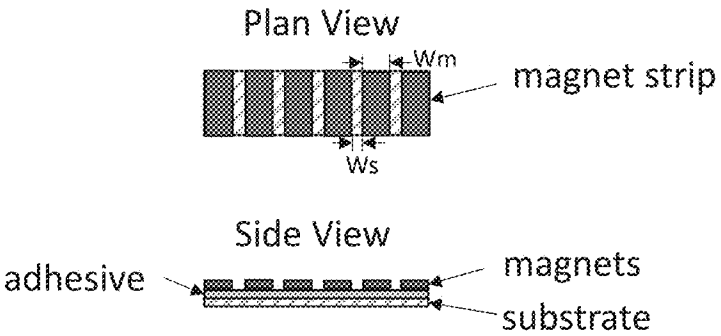
FIG. 51 illustrates a plan view and side view of a magnetic strip according to another implementation.

FIGS. 19-27 show another embodiment in which several rectangular shaped magnets are coupled side by side to a flexible substrate (e.g., using adhesive or other suitable fastening mechanism) to form a flexible closure strip (e.g., bendable). For example, the flexible closure strip may be selected from magnetized strips sold by SYSTEM MAG. The magnets for each closure are arranged next to each other (e.g., abutting) and are coupled to a substrate (e.g., coupled to a polyurethane film substrate with an adhesive, such as a silicone-based adhesive) such that adjacent magnets abut each other. In other implementations, the magnets may be spaced apart such that the width of the space between the magnets is less than a width of each magnet (e.g., such as shown in FIG. 51, wherein the width of the space Ws between adjacent magnets is less than the width Wm of each magnet). The size of the magnets used for each strip may have a length to width aspect ratio of within the range of 1:1 to 4:3 (e.g., 3:2 (e.g., a length of 6 mm and a width of 4 mm)) and a thickness that is 0.5 mm to 2.5 mm thick (e.g., 1.5 mm thick). The flexible closure strip is disposed inside a respective fabric pocket defined at the free end of the back strap and the front lower torso portion. The flexible closure strips may form any suitable shape, such as, for example, rectangular, partially triangular (e.g., V-shaped), partially trapezoidal, and semi-circular. In the implementation shown in FIGS. 19-26, the strips are arranged in a partially triangular (or V-shaped) shape.

Figure 27:
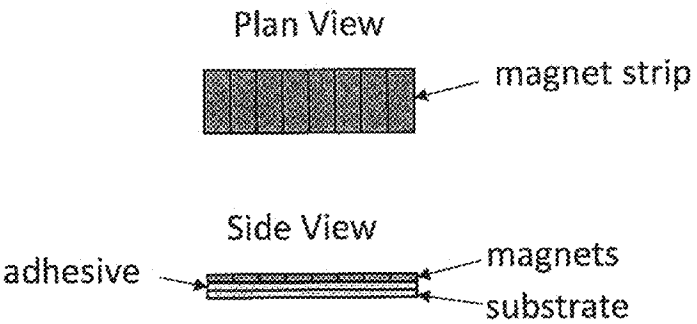
FIG. 27 illustrates a plan view and side view of a magnetic strip disposed within each of the pockets defined in the garment shown in FIG. 19.
Figure 28:
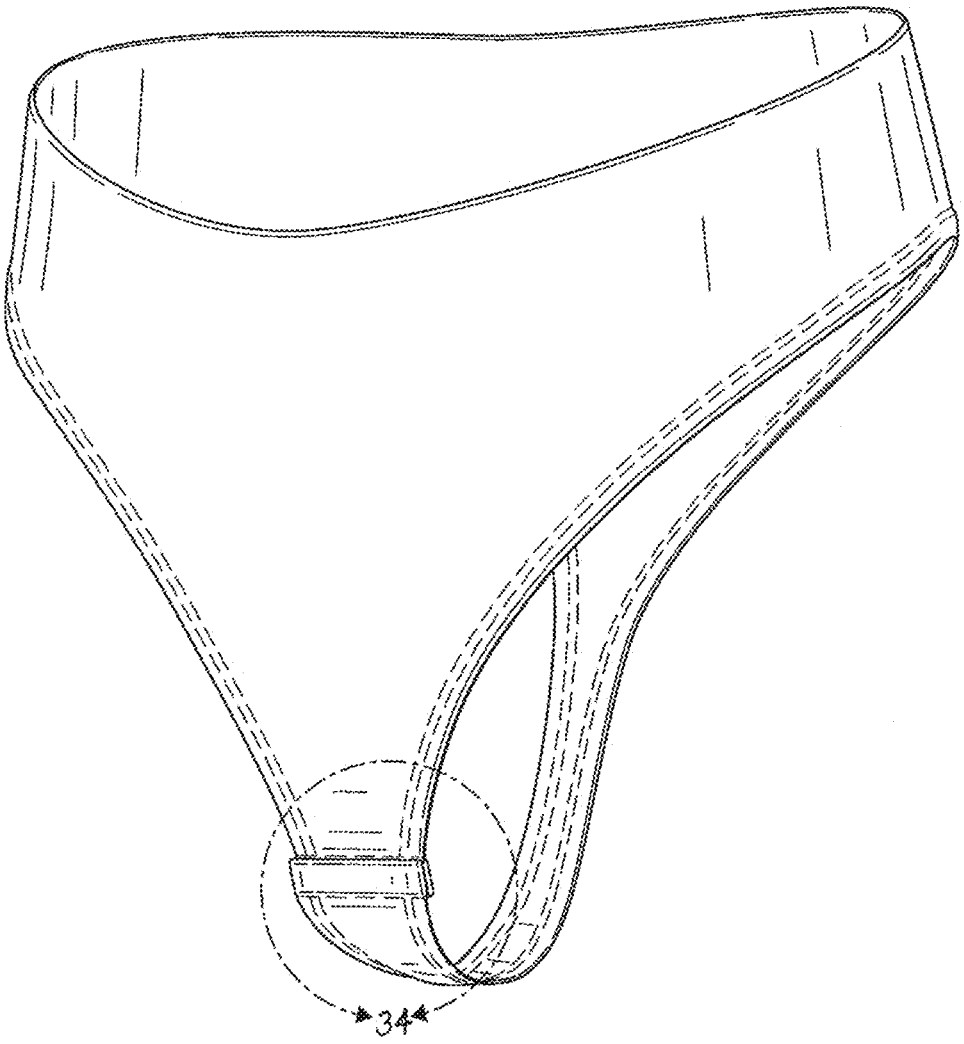
FIG. 28 illustrates a front perspective view of a clothing garment with a magnetically securable strap in a closed position according to another embodiment of the present disclosure.
Figure 29:
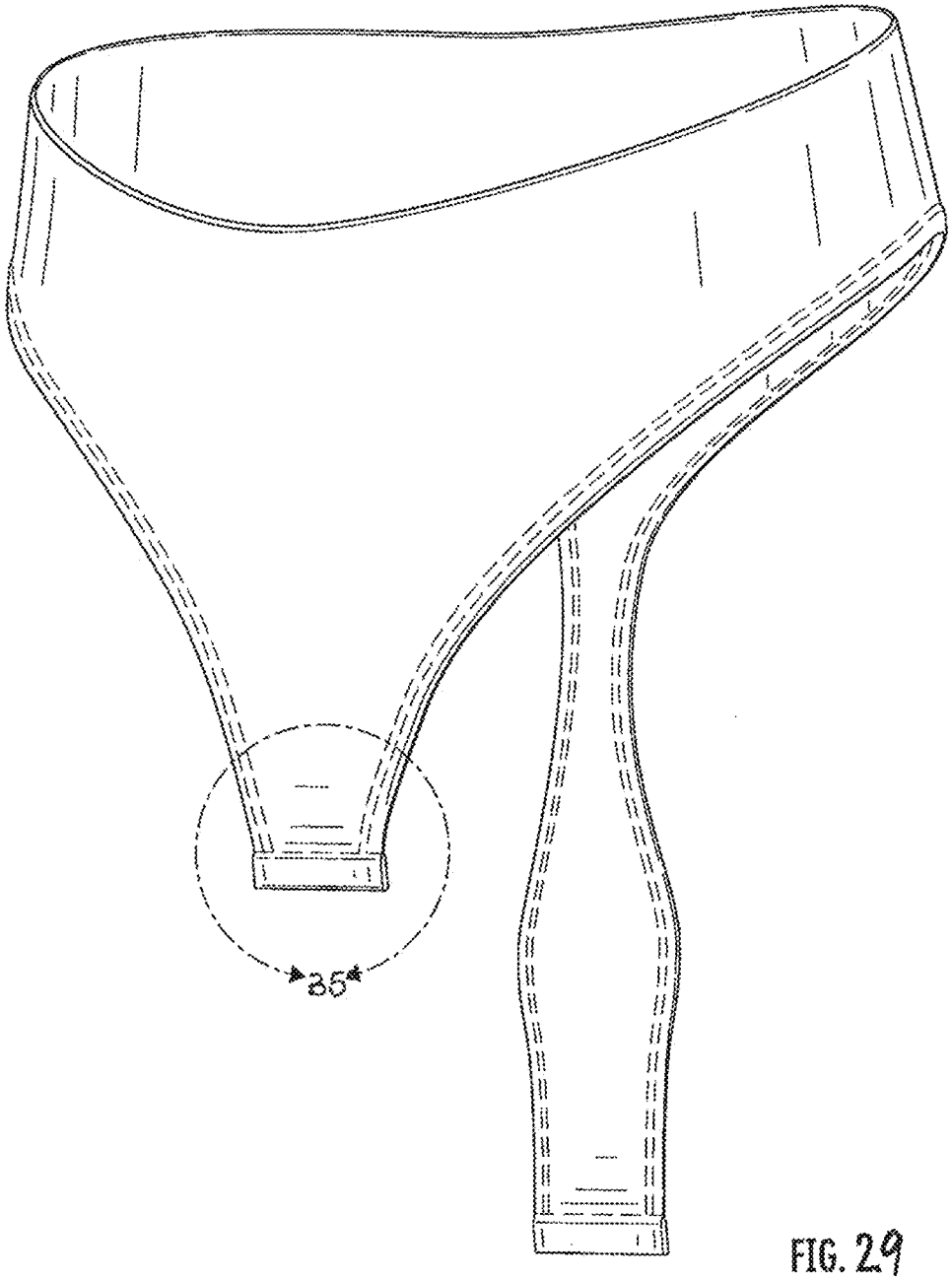
FIG. 29 illustrates a front perspective view of the garment shown in FIG. 28 with the strap in the open position.
Figure 30:
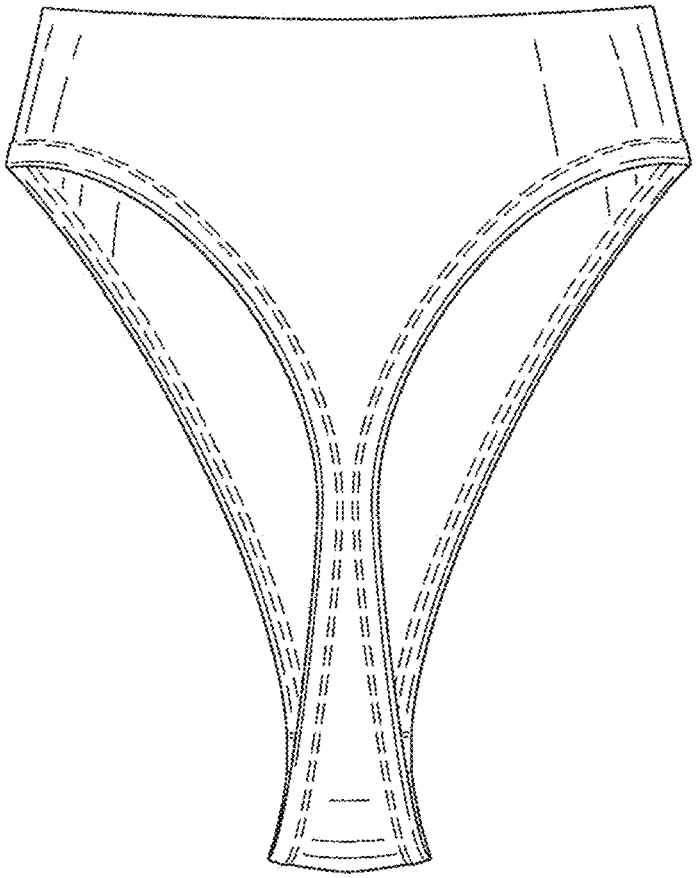
FIG. 30 illustrates a rear view of the garment shown in FIG. 28 with the strap in the closed position.
Figure 31:
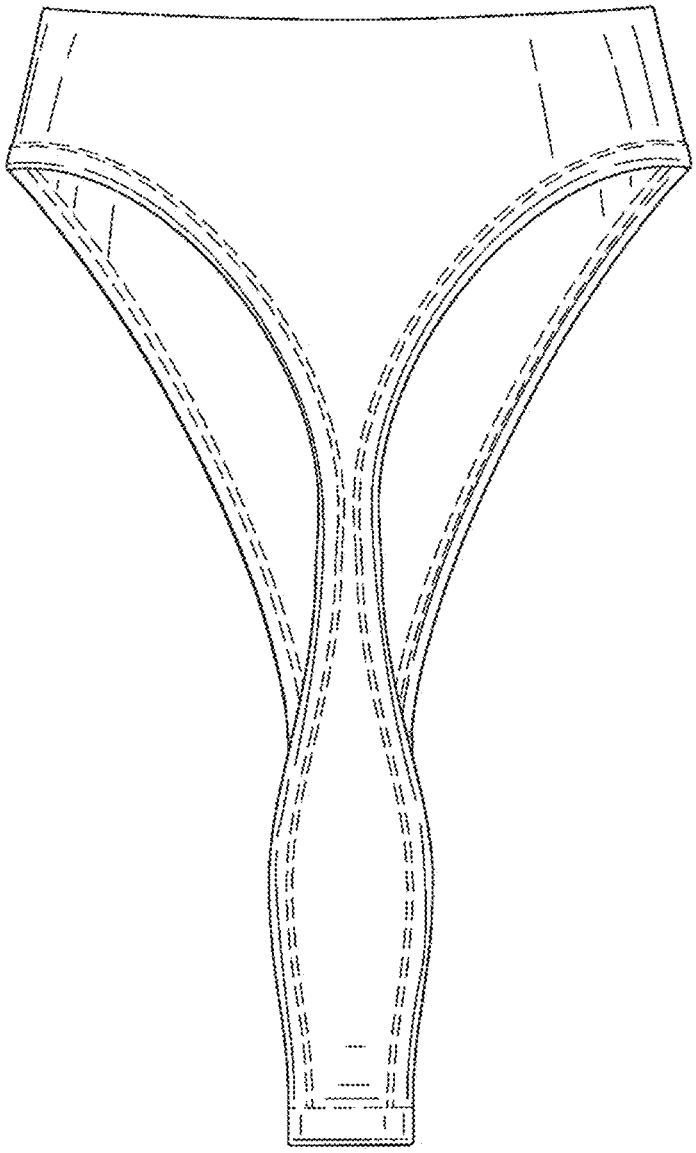
FIG. 31 illustrates a rear view of the garment shown in FIG. 29 with the strap in the open position.
Figure 32:
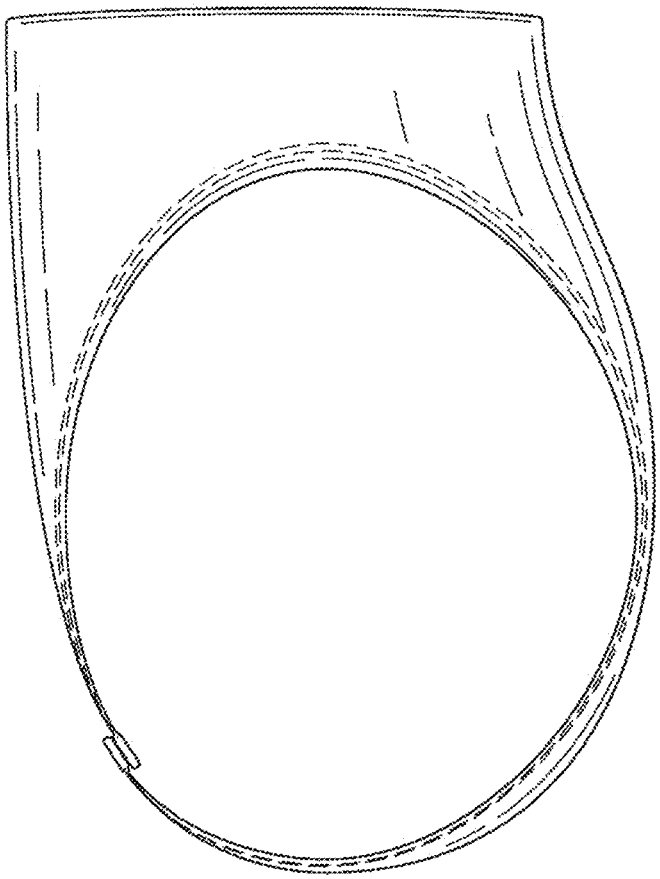
FIG. 32 illustrates a right side view of the garment shown in FIG. 28 with the strap in the closed position, wherein the left side view is a mirror image thereof.
Figure 33:
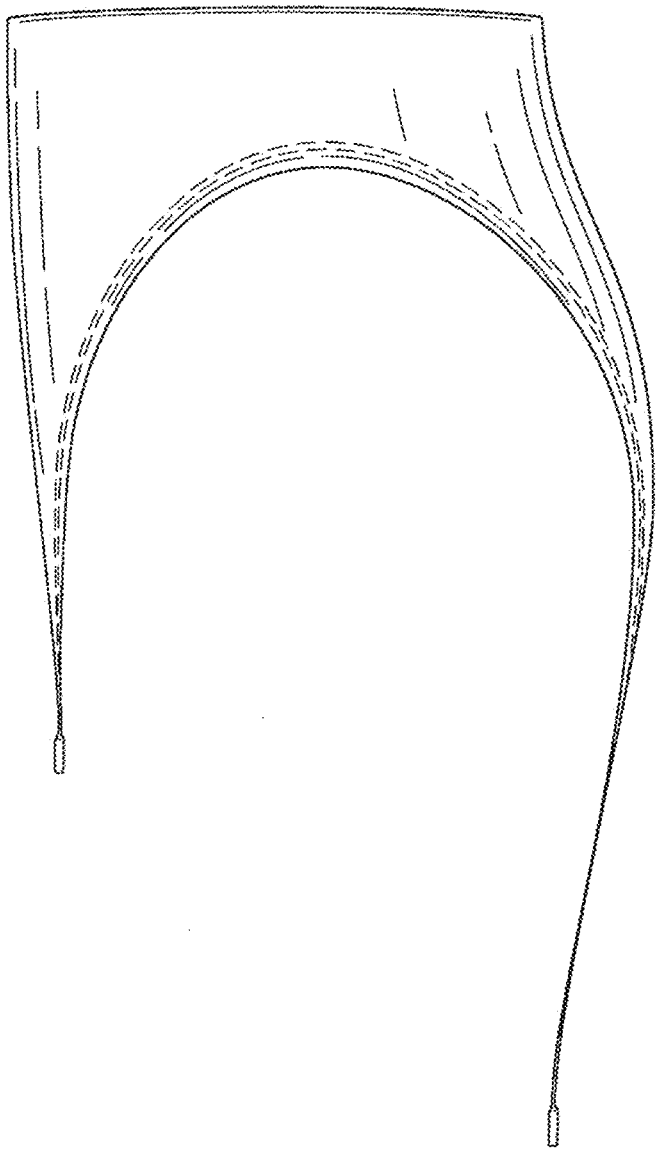
FIG. 33 illustrates a right side view of the garment shown in FIG. 29 with the strap in the open position, wherein the left side view is a mirror image thereof.
Figure 34:
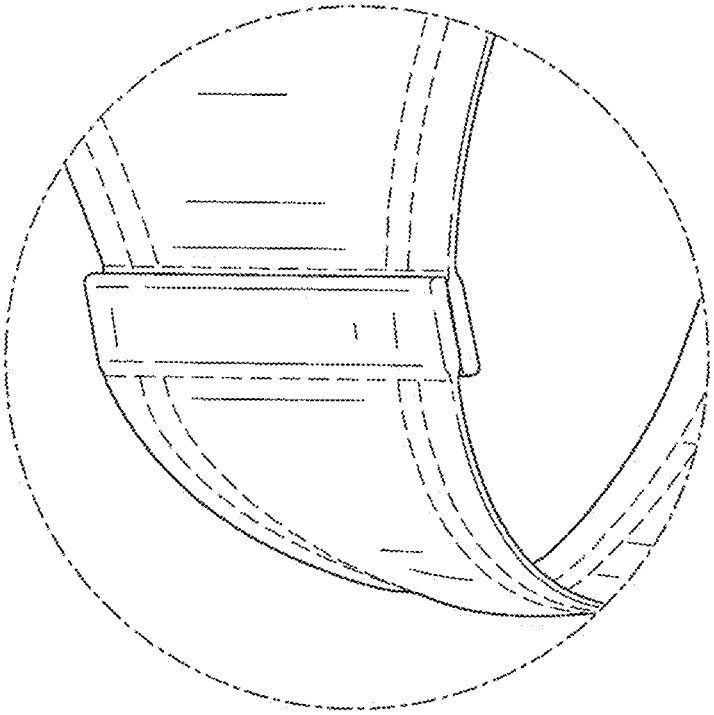
FIG. 34 illustrates a detailed view of the encircled portion 34 shown in FIG. 28.
Figure 35:
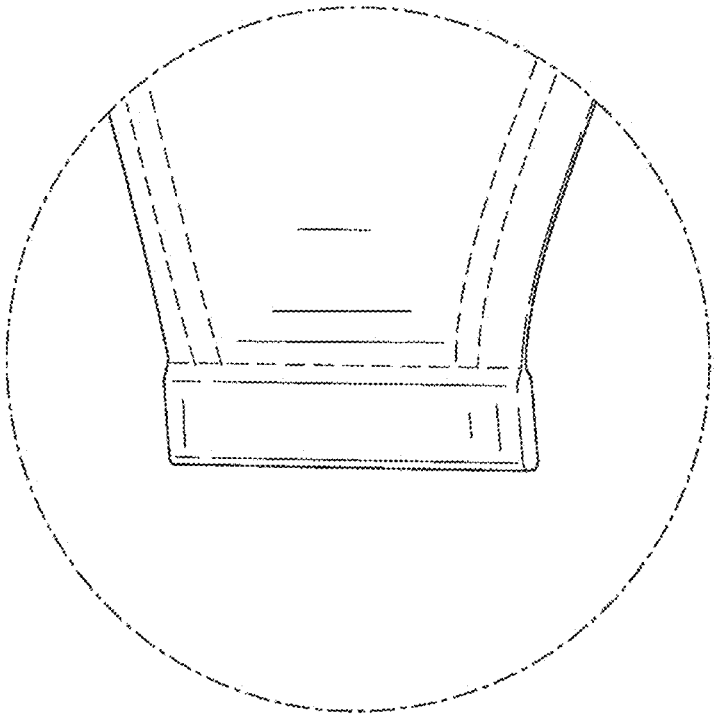
FIG. 35 illustrates a detailed view of the encircled portion 35 shown in FIG. 29.
Figure 34:
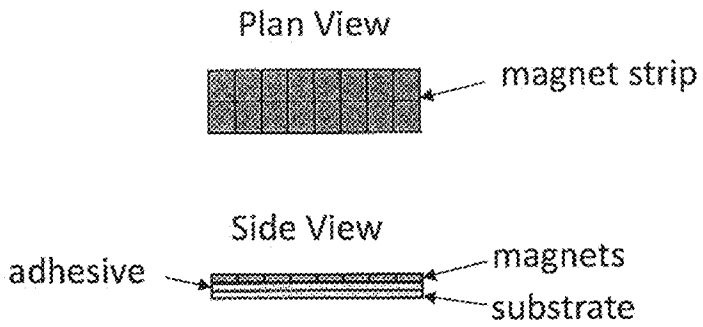

As shown in FIGS. 27 and 36, the magnetic closure disposed in each pocket includes a plurality of individual rectangularly shaped magnets that are coupled to a substrate using an adhesive. The magnets are arranged side by side to abut each other. The magnets in FIG. 27 are arranged in a single linear row. And, the magnets in FIG. 36 are arranged in two linear rows that abut each other.

The pockets protect the magnet closures and can decrease their visibility. Each pocket may be integrally formed (e.g., sewn or welded or adhered onto itself) or be separately formed from the same type of fabric or a different fabric and coupled to an outer or inner surface of the garment (e.g., via stitching, welding, adhesive, staples, or other suitable fasteners or fastening mechanisms). The pockets are disposed on the front lower torso portion, the back lower torso portion, and/or a strap coupled to the front lower torso portion or the back lower torso portion.

In the implementation shown in FIGS. 28-35, a front pocket is integrally formed at a lower end of the front torso portion and a back pocket is integrally formed at a free end of the strap portion that is coupled to the back lower torso portion. For example, in the implementation shown, the fabric at the lower end of the front torso portion is folded over toward the inner surface of the front torso portion and sewn along three sides of the magnet closure. The magnet closure is disposed within the pocket formed by the stitching along the three sides through the opening at the fourth side, and then the fourth side is stitched to close the pocket. In this example, the fourth side is one of the ends of the magnet closure that has equal or less length than the other sides. The pocket of the strap is formed similarly.

In an implementation in which the magnet closure has at least a partial triangular (or V-shaped) arrangement, such as shown in FIGS. 19-27, the pocket may be formed by forming parallel stitches through the portion of fabric that is folded onto itself. The parallel stitches are spaced apart to define a channel between them for receiving each magnet strip that forms the magnet closure. The magnet strips are disposed within the channels, and the ends of the channels are stitched to close the pockets. Other steps of forming pockets for receiving magnet closures having these or different arrangements are within the scope of this disclosure.

A thickness of the fabric covering each magnet closure on the side of the magnet closure that faces the other magnet closure affects the strength of the closures—e.g., a thicker fabric decreases the strength of the closures. In addition, a fabric with a higher coefficient of friction may increase the strength relative to a fabric with a lower coefficient of friction.

In various aspects, a garment can comprise many various configurations and shapes. In further aspects, the garment can comprise a garment body or torso portion that may have a substantially tubular or cylindrical shape to cover a user's torso area, apertures or openings, for example, that would allow a user to pull the garment over their head and/or step into it, and a strap or flap portion to connect a front and a rear portion of the garment body, thus substantially securing the garment to a user's body.

In further aspects, the openings (or upper and lower apertures) comprise at least one securing means or closure means. In yet further aspects, the securing means can be encased or embedded in at least one portion of the garment body. In even further aspects, at least one opening can comprise a first securing means and a second securing means.

In some implementations, the garments may meet OEKO-TEX® Standard 100, Product class II (Edition 3.2021), which is an internationally recognized label in the field of personal protection from undesirable substances. For example, garments meeting this standard do not include magnets that contain nickel, which is often used in coatings.

Figure 37:
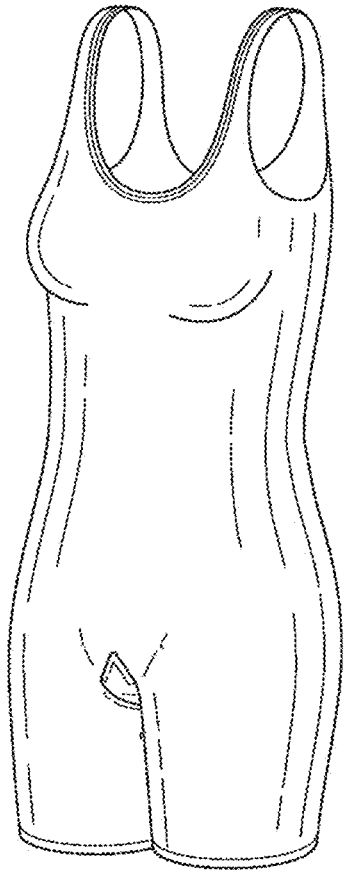
FIGS. 37-50 illustrate examples of other garments according to various implementations.
Figure 38:
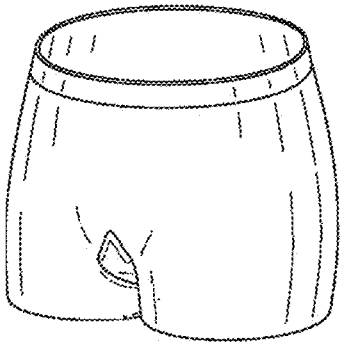
Figure 39:
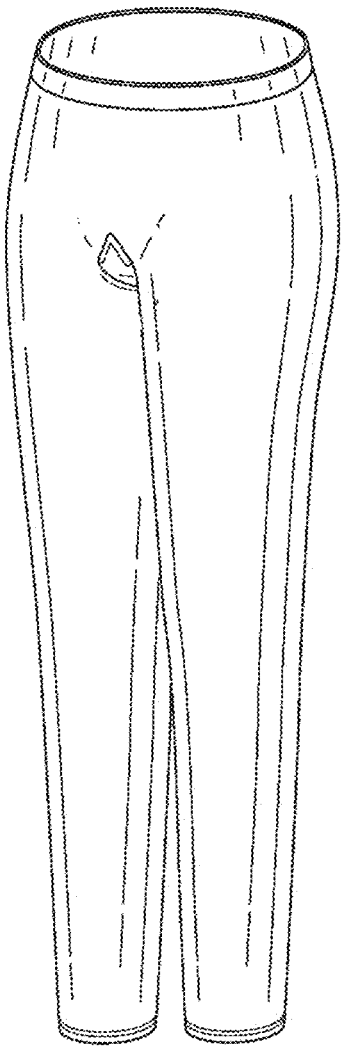
Figure 40:
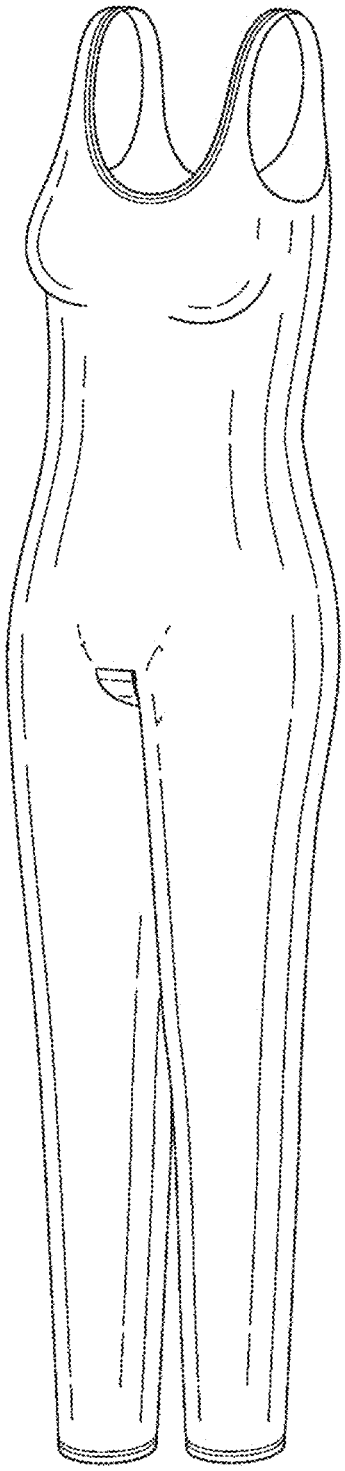
Figure 41:
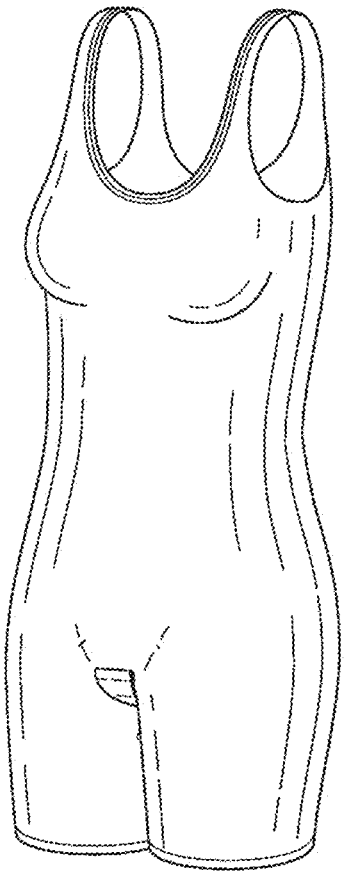
Figure 42:
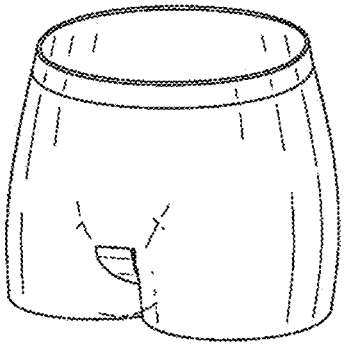
Figure 43:
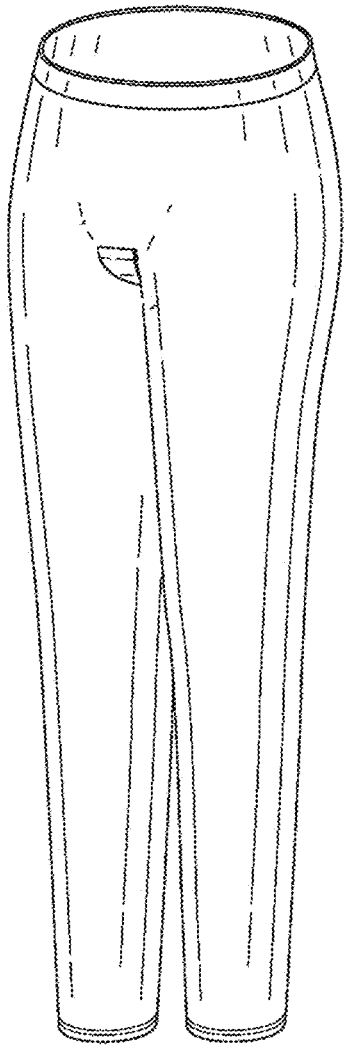

The implementation shown in FIGS. 19-26 is a full body suit that defines an opening (e.g., rectangular shaped) at the wearer's crotch. The opening allows the wearer to use the bathroom when the strap is uncoupled to the front panel of the body suit. Other types of garments may also define this opening for use with the strap, such as the short-length full body suit in FIG. 37, the shorts in FIG. 38, the leggings in FIG. 39, the full body suit with a rectangular shaped closure in FIG. 40, the short-length full body suit with a rectangular shaped closure in FIG. 41, the shorts with the rectangular shaped closure in FIG. 42, and the leggings with the rectangular shaped closure in FIG. 43.

Figure 44:
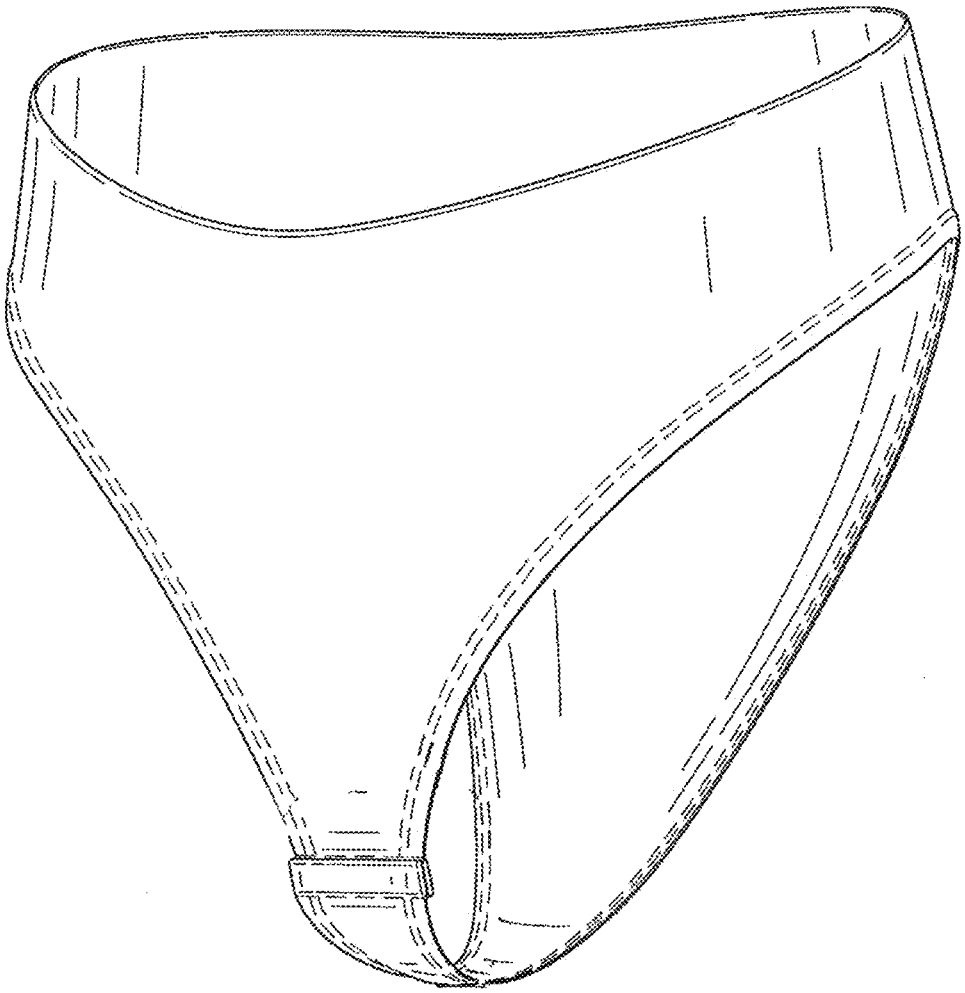
Figure 45:
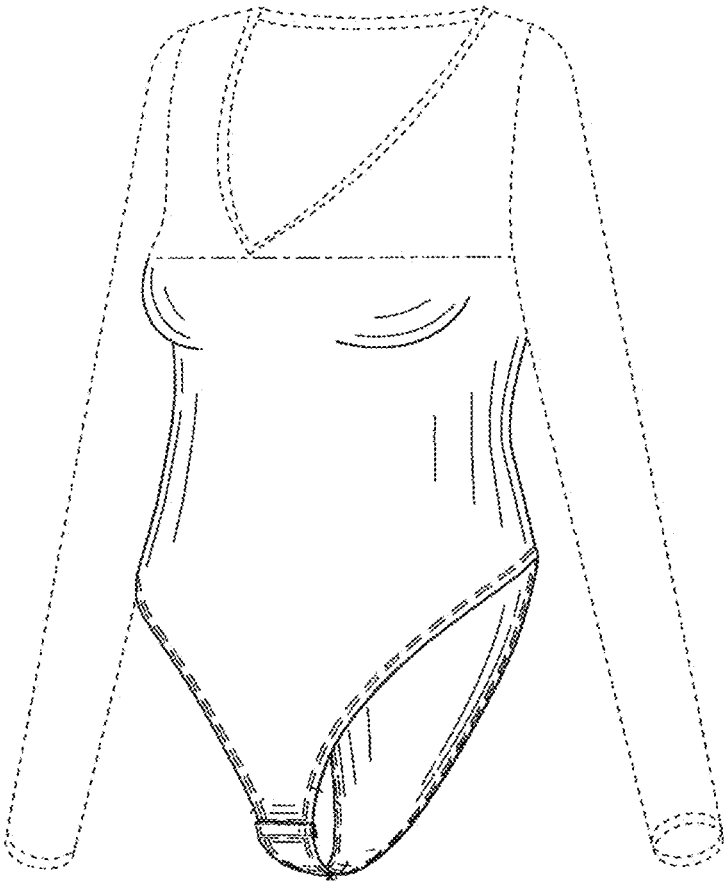
Figure 46:
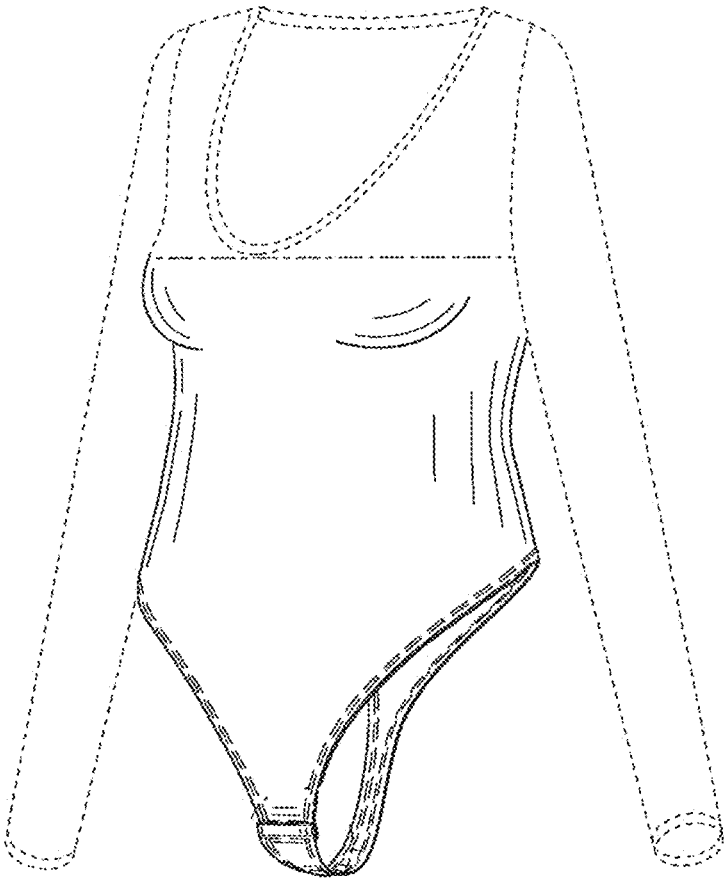
Figure 47:
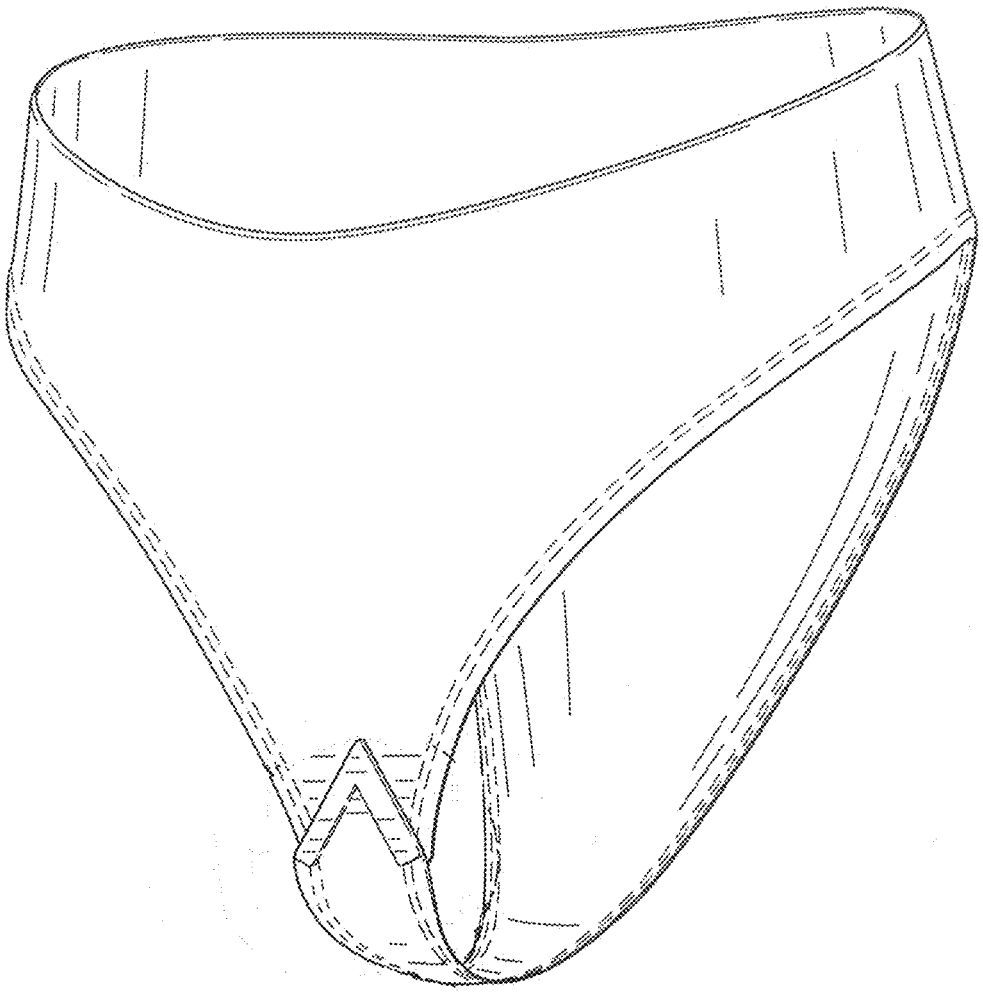
Figure 48:
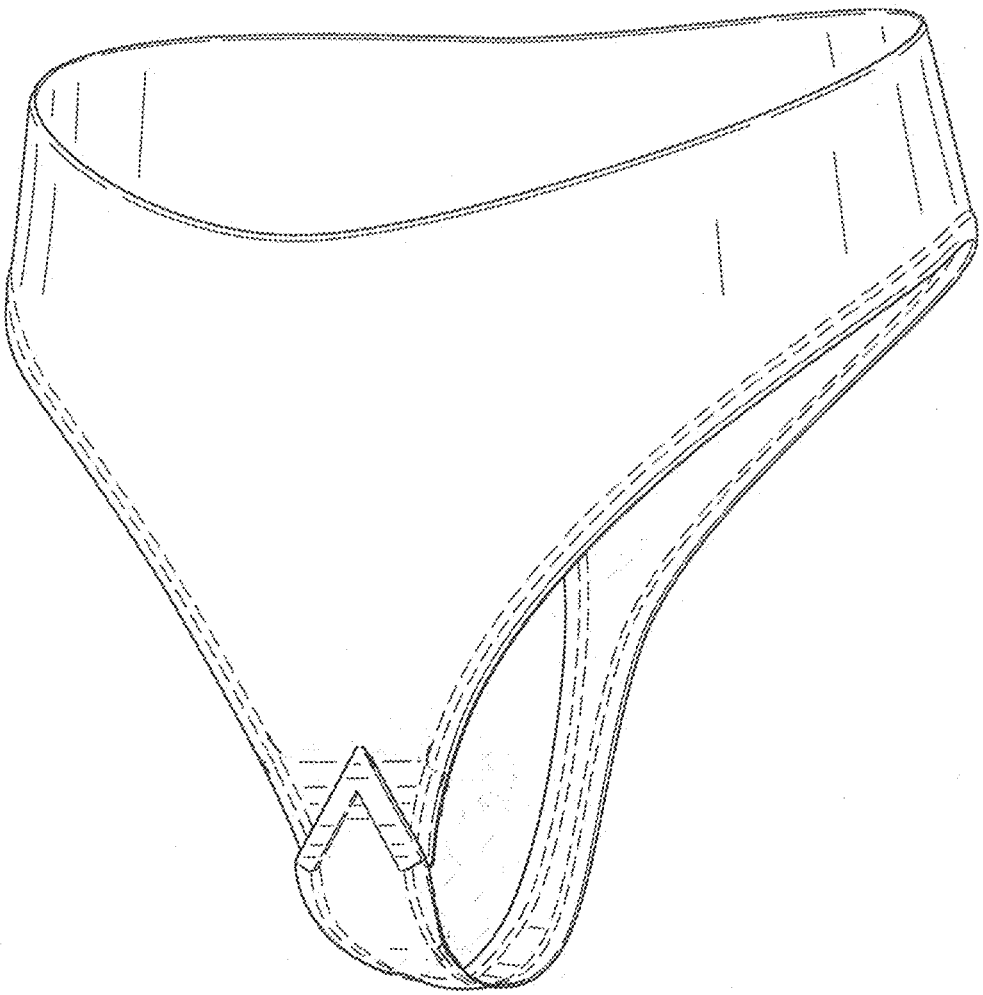
Figure 49:
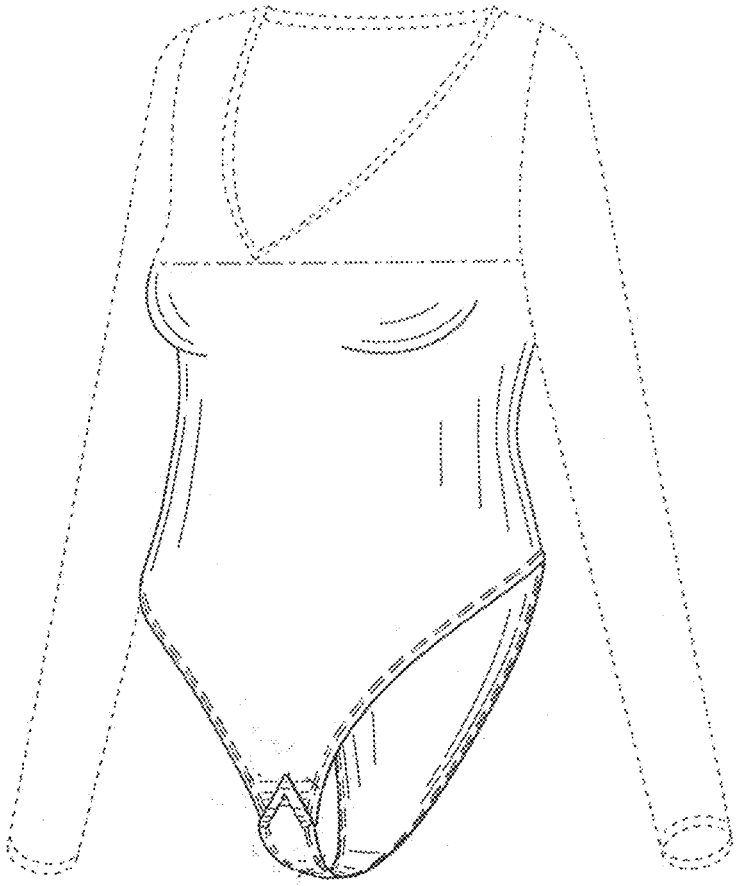
Figure 50:
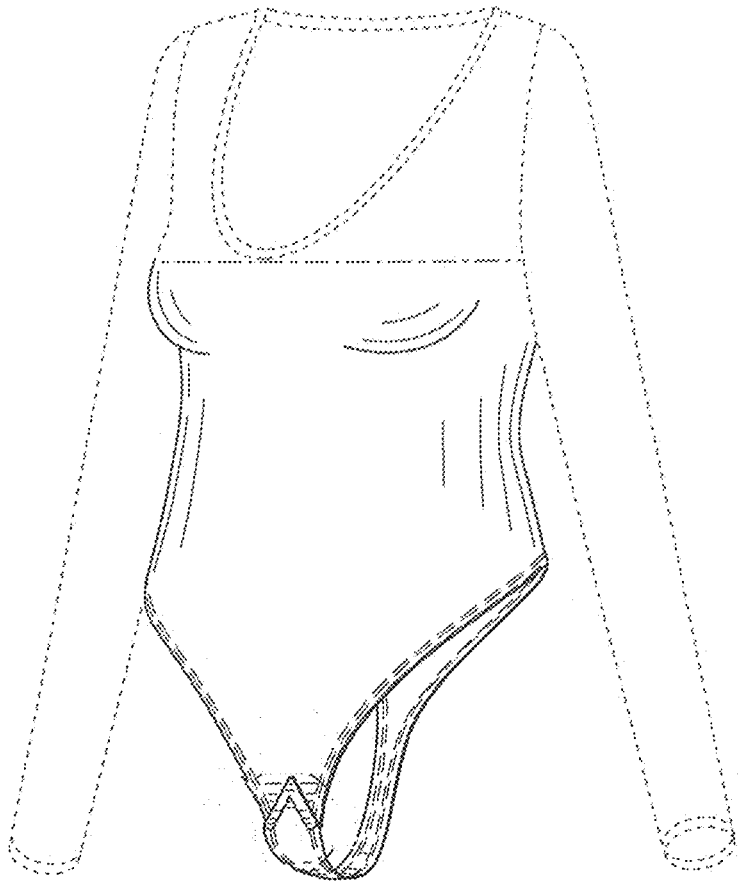

The implementation shown in FIGS. 28-35 is a thong panty with a rectangular shaped closure, and another implementation of a thong panty with a partial triangular shaped closure is shown in FIG. 48. The implementation shown in FIG. 44 is a full coverage panty with a rectangular shaped closure, and the implementation shown in FIG. 47 is a full coverage panty with a partial triangular shaped closure. The implementation shown in FIG. 45 is a body suit with full coverage of the wearer's bottom and a rectangular shaped closure, and the implementation shown in FIG. 49 is a body suit with full coverage of the wearer's bottom and a partial triangular shaped closure. The implementation shown in FIG. 46 is a body suit with thong and a rectangular shaped closure, and the implementation shown in FIG. 50 is a body suit with thong and a partial triangular shaped closure.

In one aspect, the present disclosure provides a magnetically securing clothing garment comprising: a torso portion or garment body configured to be worn over a torso of a user and a strap portion configured to connect a back side and a front side of the torso portion using at least one securing means, and extending from a first location on a first side of the torso portion to a second location on a second side of the torso portion and the strap portion there between being circumferentially disposed over a groin area and between legs of the user. In further aspects, when connected, the strap portion defines first and second lower apertures located between the lower front portion and the lower back portion, each lower aperture configured to accommodate a limb of the user donning the garment.

Embodiments of the present disclosure may comprise methods, systems, and components comprising, but not limited to:

A. A garment body with a lower torso portion, and

B. A strap portion that couples a front lower torso portion and a rear lower torso portion, In some embodiments, the present disclosure may provide an additional set of components for further facilitating the system. The additional set of components may comprise, but not be limited to:

C. An optional upper torso portion, with or without sleeves (e.g., full or shorten sleeves) and having various types of collar shapes (e.g., turtleneck, scoop front with scoop back, scoop front with straight back, crew shaped, V-neck front with straight back, or V-neck front with V-shaped back), and/or D. Optional pantlegs coupled to the lower torso portion (e.g., full length, short lengths, or capri lengths).

Details with regard to each component are provided below. Although components are disclosed with specific functionality, it should be understood that functionality may be shared between components, with some functions split between components, while other functions are duplicated by the components. Furthermore, the name of the component should not be construed as limiting upon the functionality of the component. Moreover, each stage disclosed within each component can be considered independently without the context of the other stages within the same component or different components. Each stage may contain language defined in other portions of this specifications. Each stage disclosed for one component may be mixed with the operational stages of another component. In the present disclosure, each stage can be claimed on its own and/or interchangeably with other stages of other components.

The following depicts an example of a method of a plurality of methods that may be performed by at least one of the aforementioned components. Various hardware components may be used at the various stages of operations disclosed with reference to each component. For example, although methods may be described to be performed by a single apparatus, it should be understood that, in some embodiments, different operations may be performed by different apparatuses operating in conjunction with each other. For example, the magnetically securing clothing garment may be employed in the performance of some or all of the stages disclosed with regard to the methods. Similarly, one apparatus may be employed in the performance of some or all of the stages of the methods. As such, the apparatus may comprise at least one of the architectural components disclosed herein.

Furthermore, although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed without altering or deterring from the fundamental scope of the depicted methods and systems disclosed herein.

Consistent with embodiments of the present disclosure, a method may be performed by at least one of the aforementioned components. The method may be embodied as, for example, but not limited to, computer instructions, which when executed, perform the method. The method may comprise the following stages, according to various implementations:

A method for assembling a magnetically securing clothing garment, the method comprising:

providing a torso portion comprising:

providing a front lower portion, providing a front upper portion, providing a back lower portion, and providing a back upper portion;

connecting a first back strap portion of a back strap to the back lower portion, the back strap being substantially longer in length than a front strap;

connecting a first front strap portion of a front strap to the lower front portion;

connecting a second back strap portion of the back strap embedded with a securing means to a second front strap portion of the front strap embedded with a securing means at the pubic mound area of the user; and covering, when the second back strap portion and the second front portion are connected, the crotch area of a user of the garment via the back strap and the front strap.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and subcombinations described in the detailed description.

II. Garment Configuration

According to various further aspects, the garments, devices, systems, and methods of the present disclosure can comprise multiple configurations. FIGS. 1-18 illustrate nonlimiting examples of embodiments of operating environments, mechanisms, and components for the disclosed garments, devices and systems. Although the operating environments, mechanisms, and components are disclosed with specific functionality, it should be understood that functionality may be shared between mechanisms and/or components, with some functions split between mechanisms and/or components, while other functions duplicated by the mechanisms and/or components. Furthermore, the name of the mechanisms, parts and/or components should not be construed as limiting upon the functionality of the mechanisms, parts and/or components. Moreover, each stage in the claim language can be considered independently without the context of the other stages. Each stage may contain language defined in other portions of this specifications. Each stage disclosed for one mechanism, part and/or component may be mixed with the operational stages of another mechanism, part and/or component. Each stage can be claimed on its own and/or interchangeably with other stages of other mechanisms, parts and/or components.

One possible embodiment may be provided by the LUSCA™ suite of products and garments from Mollusca Atelier LLC.

A. Torso Portion

Figure 2:
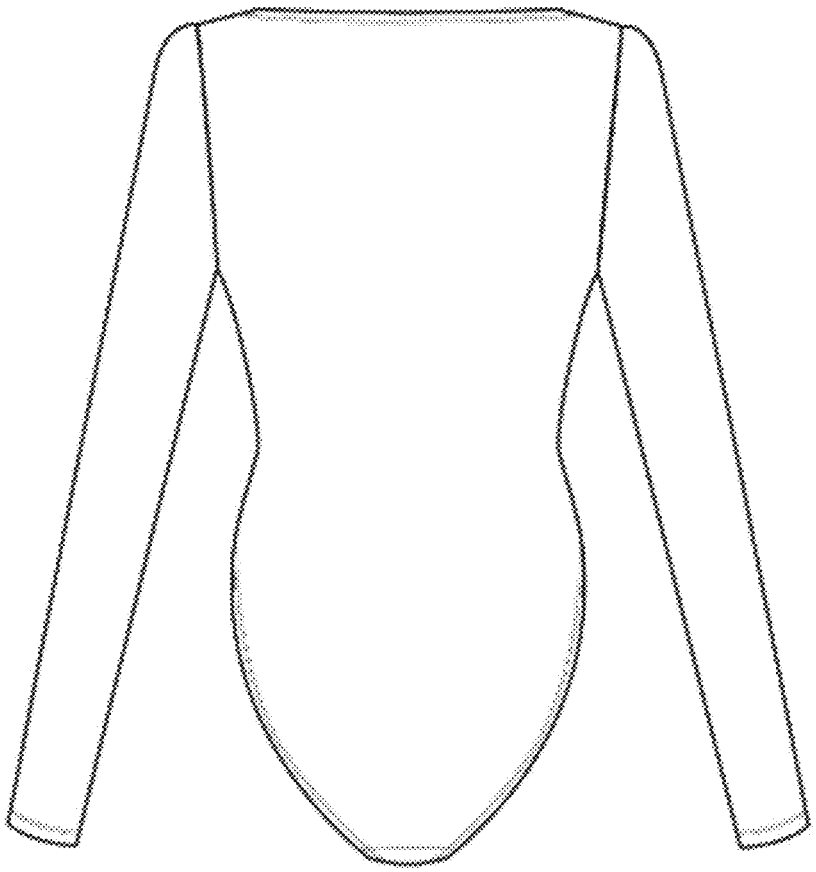
FIG. 2 illustrates a back view of the magnetically securing clothing garment shown in FIG. 1.
Figure 3:
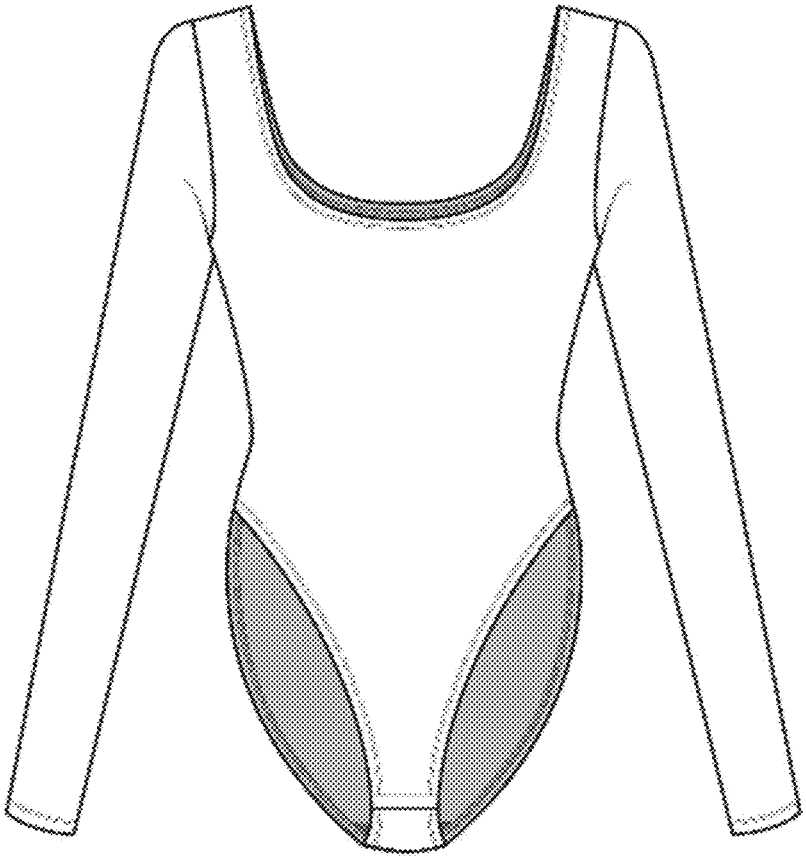
FIG. 3 illustrates a front view of a magnetically securing clothing garment according to another embodiment of the present disclosure.
Figure 4:
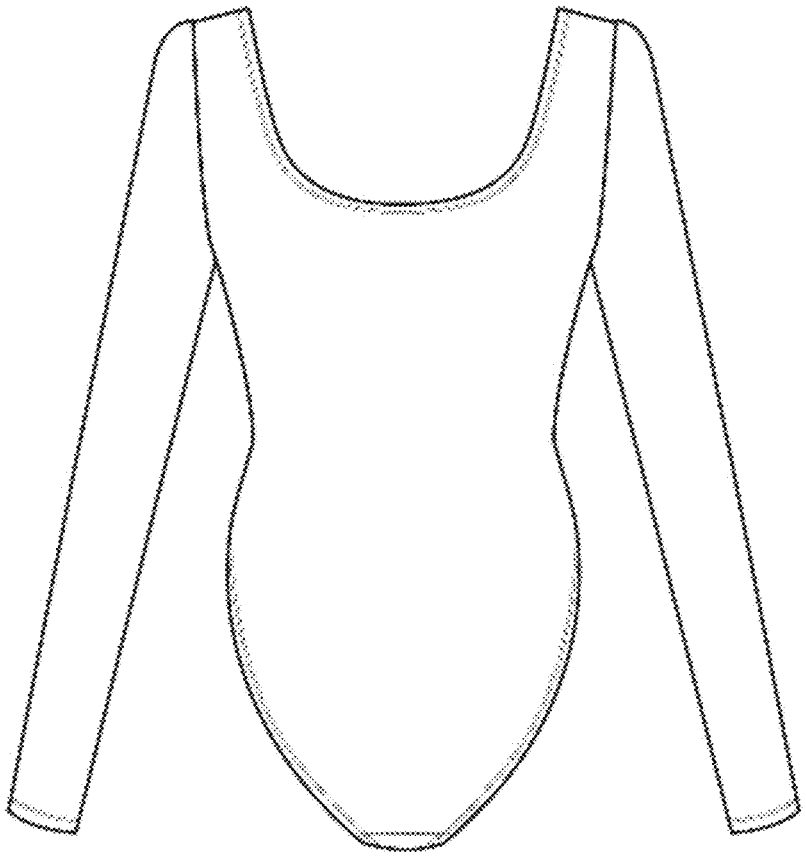
FIG. 4 illustrates a back view of the magnetically securing clothing garment shown in FIG. 3.
Figure 5:
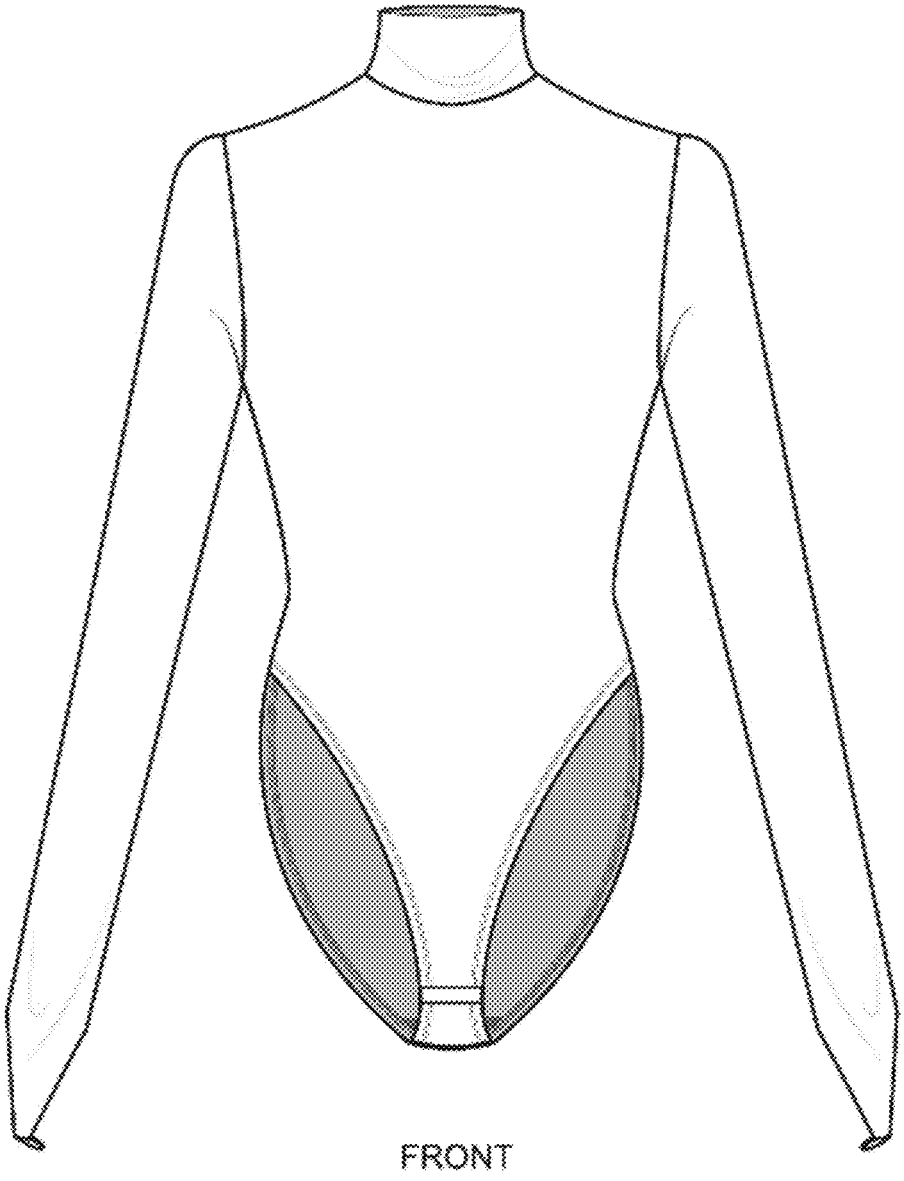
FIG. 5 illustrates a front view of a magnetically securing clothing garment according to another embodiment of the present disclosure.
Figure 6:
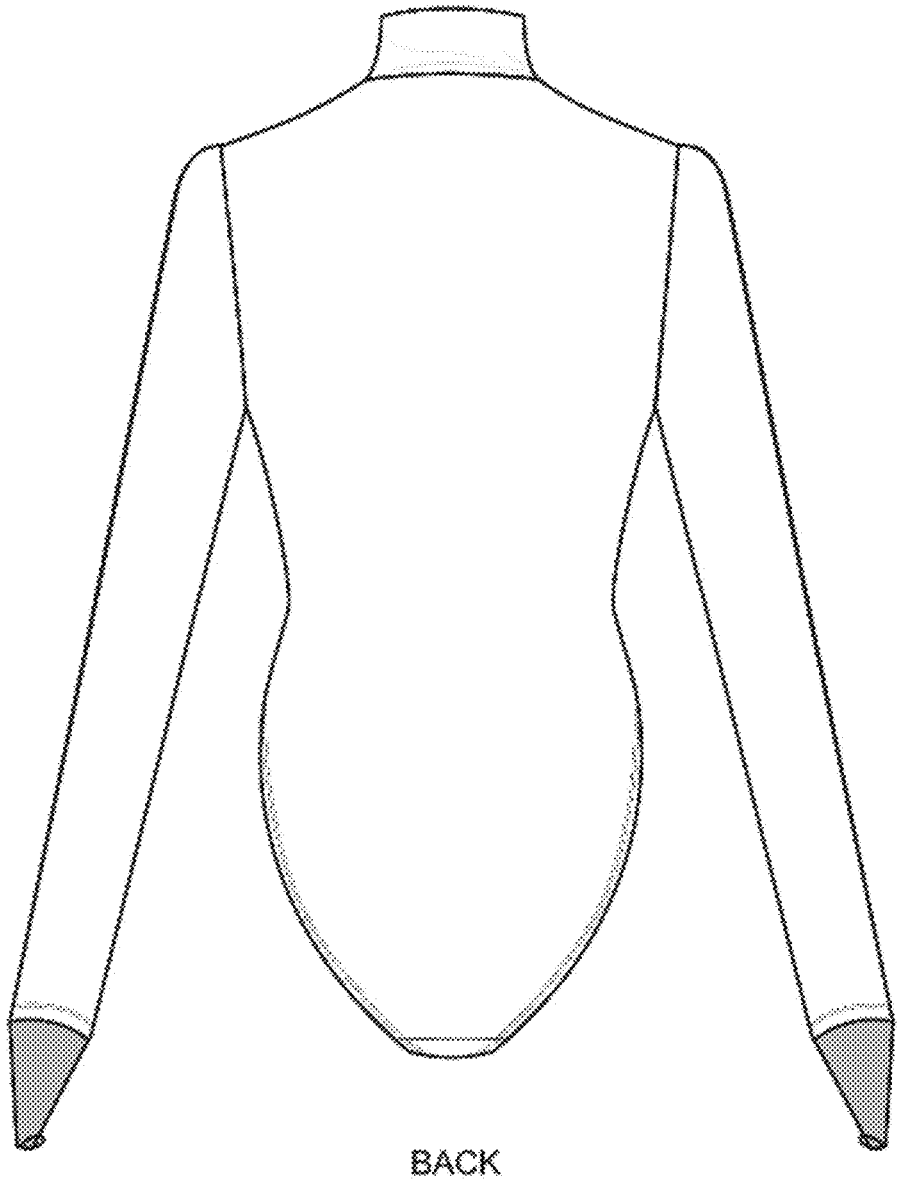
FIG. 6 illustrates a rear view of the magnetically securing clothing garment shown in FIG. 5.
Figure 7:
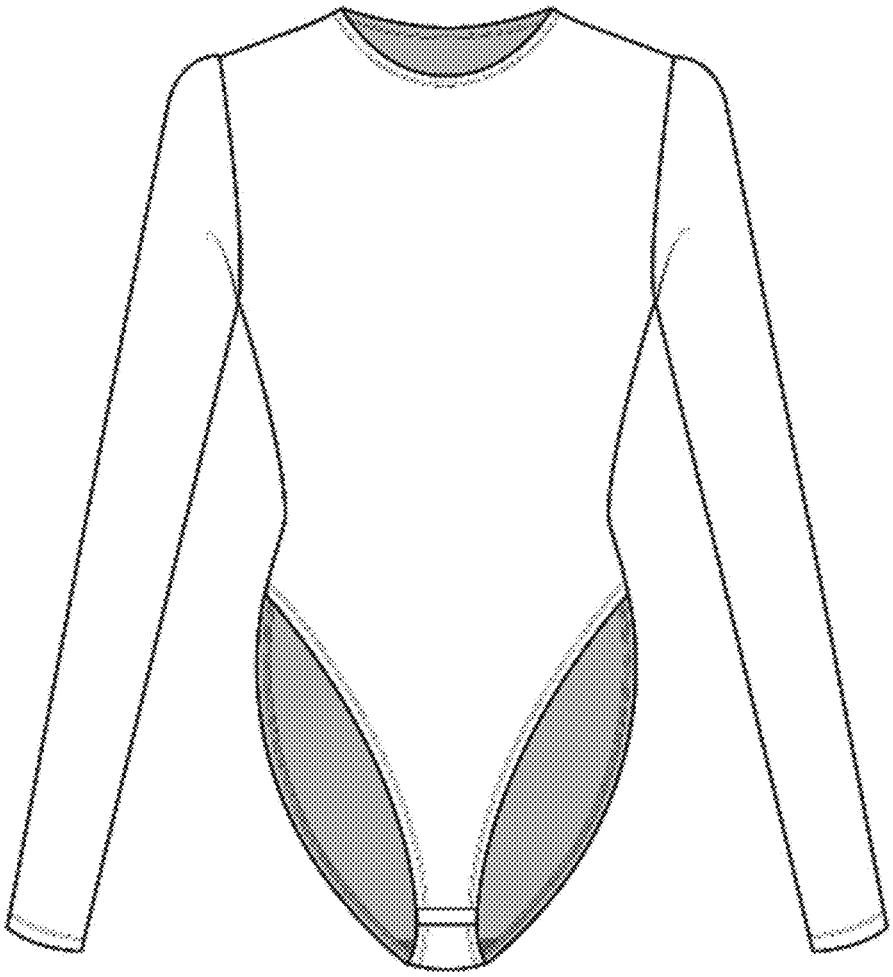
FIG. 7 illustrates a front view of a magnetically securing clothing garment according to another embodiment of the present disclosure.
Figure 8:
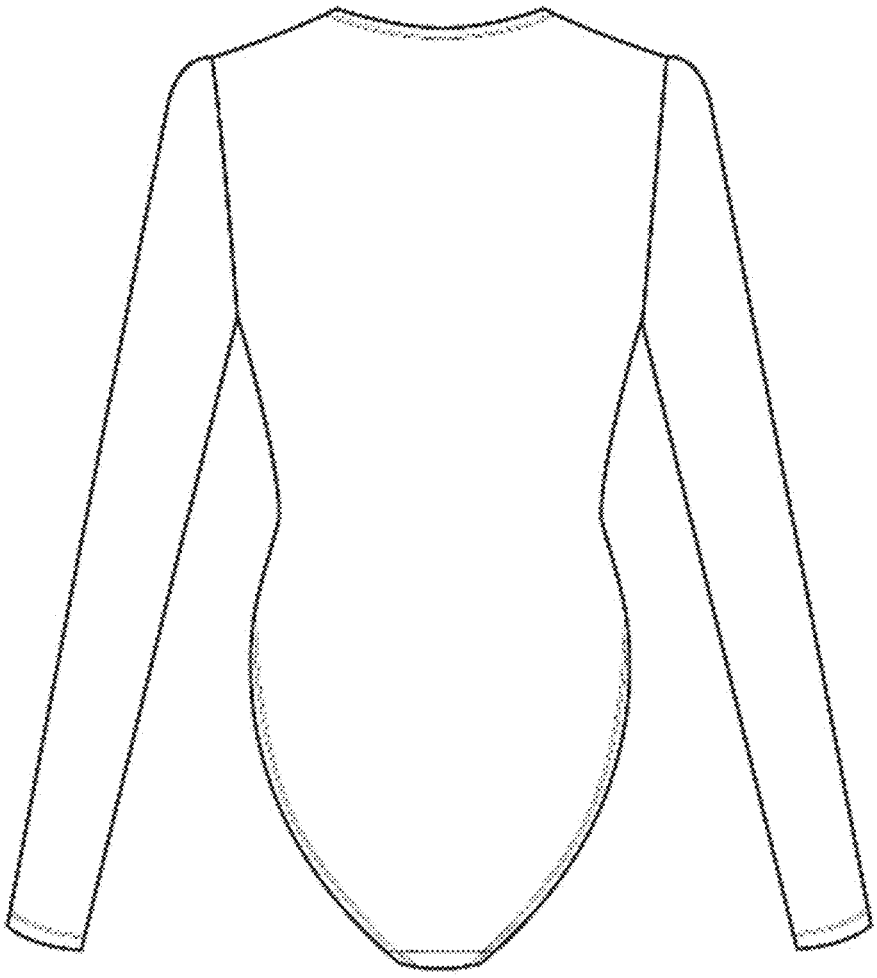
FIG. 8 illustrates a rear view of the magnetically securing clothing garment shown in FIG. 7.

FIGS. 1-2 illustrate a torso portion consistent with an embodiment of the present disclosure. In some embodiments, the torso (which may also be referred to herein as "torsal" or "trunk") portion may comprise a garment body configured to be worn over the torso of a user of the garment. In further embodiments, the torso portion may be configured to completely cover the torso. In other embodiments, the torso portion may be configured to partially cover the torso (e.g., the crotch area, the crotch area and the hips, the crotch area and the hips and portion of the abdomen and/or back, or the crotch area and the hips, abdomen and/or back, and chest).

In further embodiments, the torso portion may comprise a front lower portion. In yet further embodiments, the torso portion may comprise a front upper portion. In even further embodiments, the torso portion may comprise a back lower portion. In still further embodiments, the torso portion may comprise a back upper portion.

In yet still further embodiments, the torso portion may comprise a lower aperture. In some embodiments, the lower aperture may be located between the lower front portion and the lower back portion. In further embodiments, the lower aperture may be configured to accommodate at least a part of a pair of legs of a user of the garment.

In even yet still further embodiments, the torso portion may comprise an upper aperture. In some embodiments, the upper aperture may be located between the upper front portion and the upper back portion. In further embodiments, the upper aperture may be configured to accommodate at neck and head of a user of the garment.

Figure 11:
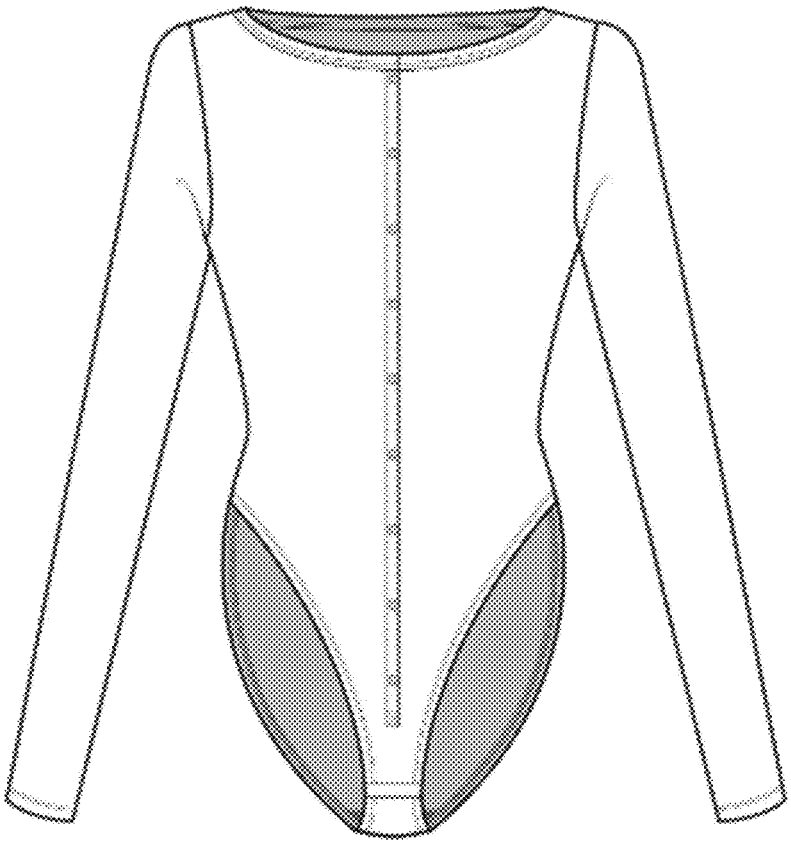
FIG. 11 illustrates a front view of a magnetically securing clothing garment according to another embodiment of the present disclosure.
Figure 12:
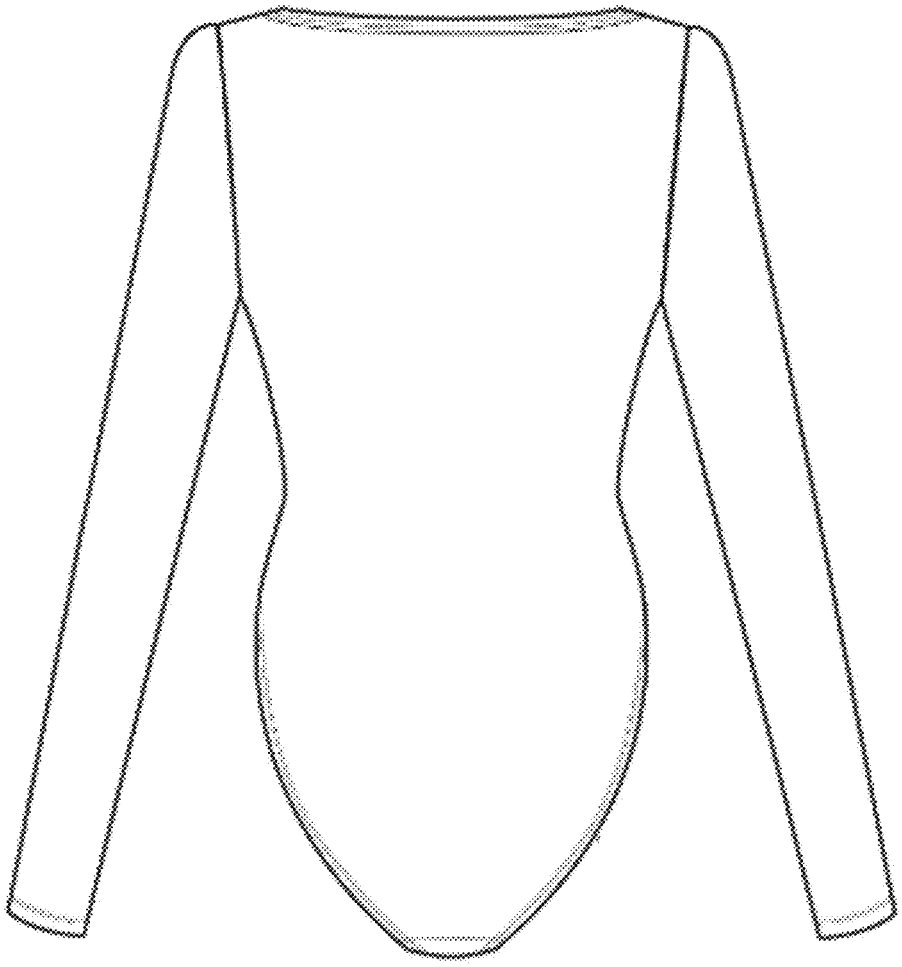
FIG. 12 illustrates a rear view of the magnetically securing clothing garment shown in FIG. 11.
Figure 13:
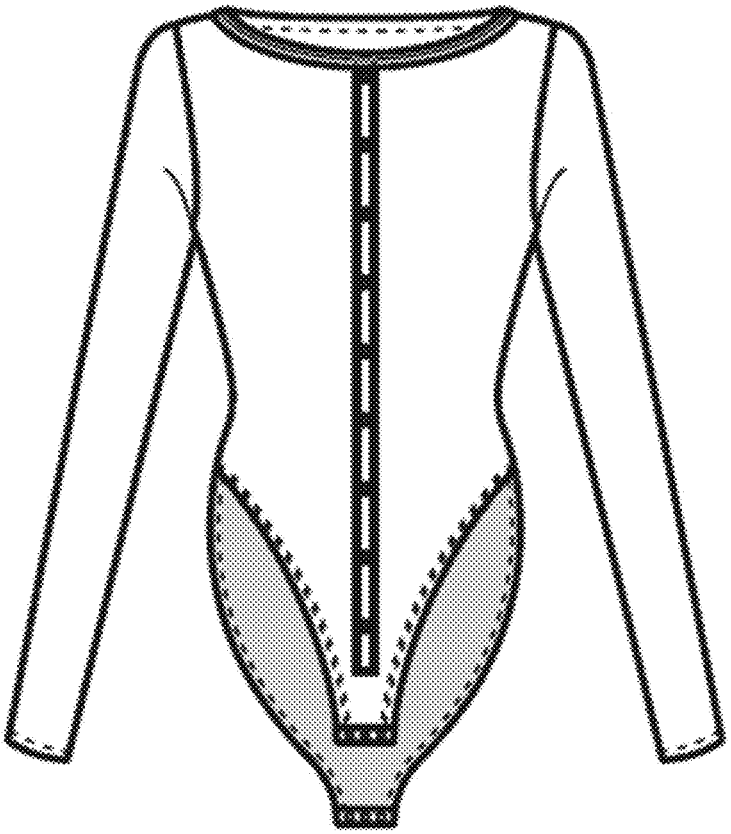
FIG. 13 illustrates a front view of a magnetically securing clothing garment according to another embodiment of the present disclosure.
Figure 14:
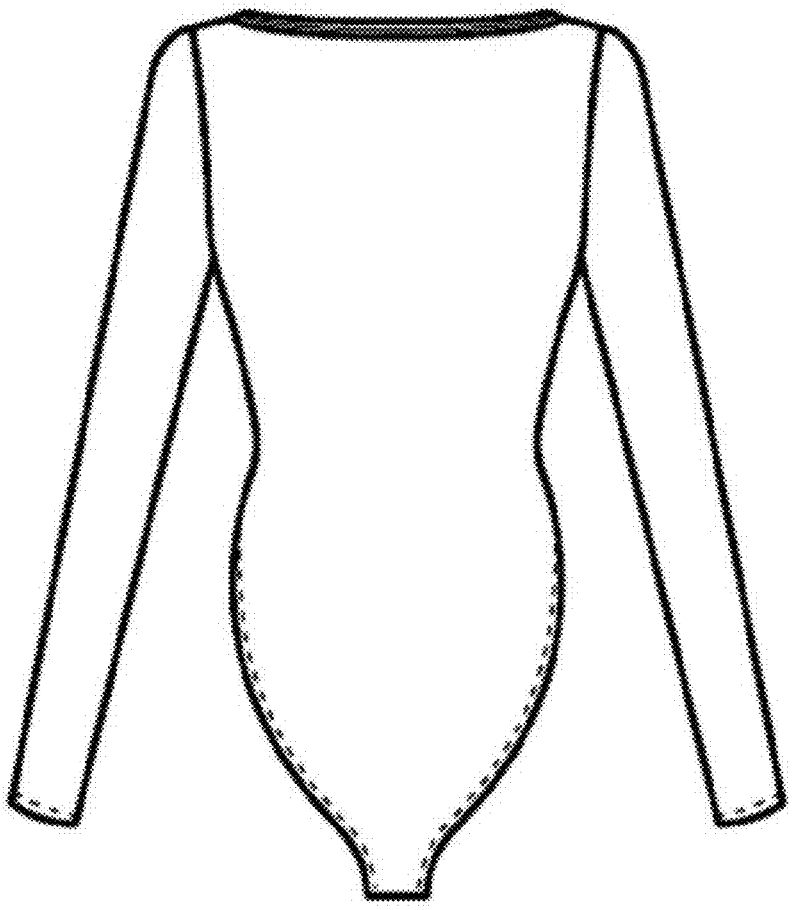
FIG. 14 illustrates a rear view of the magnetically securing clothing garment shown in FIG. 13.

In even yet still further embodiments, the torso portion may comprise a plurality of fasteners as shown in FIG. 11. In some embodiments, the plurality of fasteners may be made from at least one of the following:

a. a zipper;

b. a magnetic material;

c. a button fastener;

d. a snap button fastener; and e. a Velcro securing means.

B. Plurality of Sleeve Portions

FIGS. 3-6 illustrate a plurality of sleeve portions consistent with an embodiment of the present disclosure. In some embodiments, the plurality of sleeve portions may be configured to connect to the torso portion. In further embodiments, the plurality of sleeve portions may be configured to accommodate at least a part of an arm. In yet further embodiments, the plurality of sleeve portions may be removable.

C. Back Strap

FIGS. 9-10 and 13-14 illustrate an open back strap or garment flap consistent with embodiments of the present disclosure.

In some embodiments, the lower back strap may comprise a first back strap end that is coupled to the lower torso portion. In some embodiments, the first back strap end may be integrally formed with the lower torso portion (e.g., cut so as to stay part of the rest of the garment when manufacturing the garment) or may be separately formed (e.g., cut apart separately from the same type of fabric or a different fabric than the garment when manufacturing) and coupled to the lower torso portion (e.g., using any suitable fastener such as those disclosed herein or using a permanent fastening mechanism such as stitching, welding, stapling, and/or adhesive). The first back strap end may be coupled to the lower torso portion such that when the garment is worn, the first back strap end is within a plane that is tangential to the back of the wearer's legs and intersects the wearer's buttocks. In other implementations, the first back strap end may be coupled further toward the wearer's buttocks or further toward the wearer's crotch area.

Figure 15:
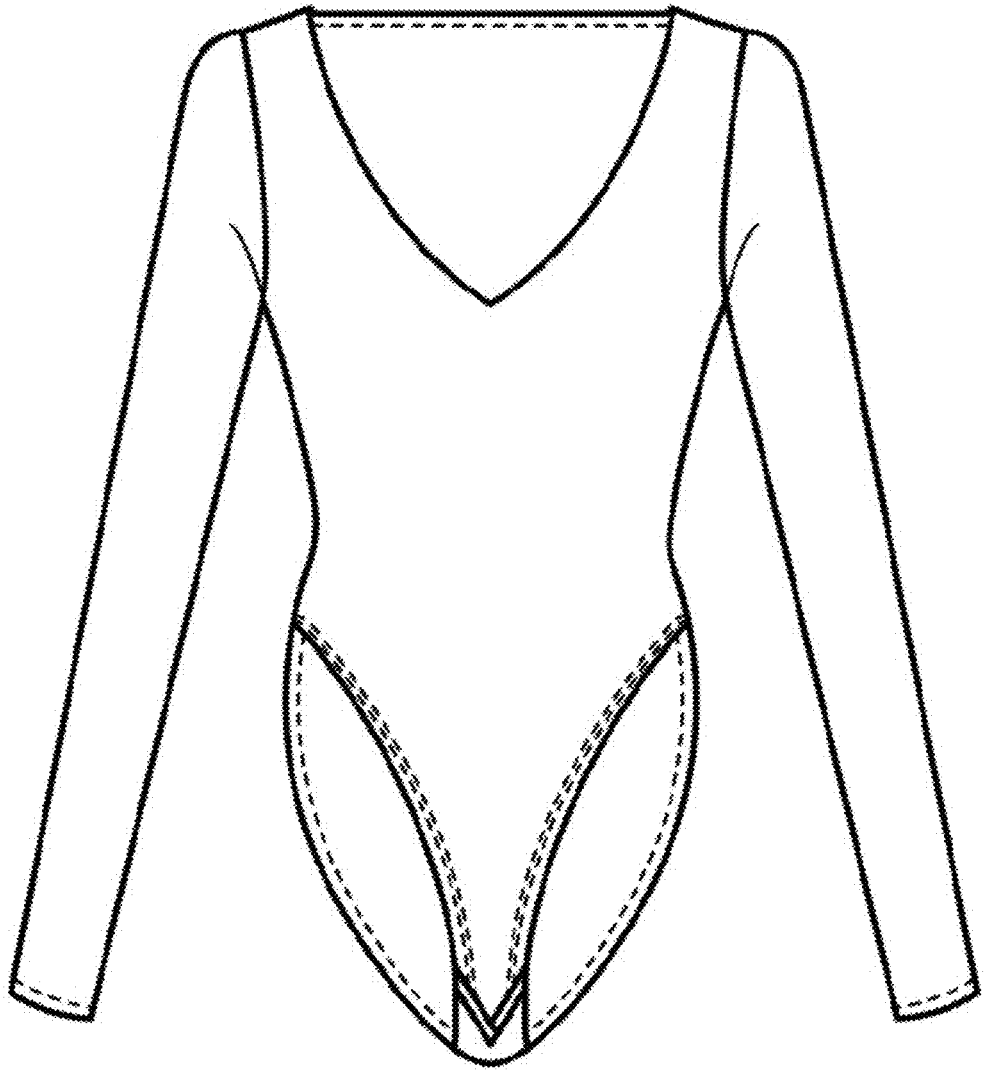
FIG. 15 illustrates a front view of a magnetically securing clothing garment according to another embodiment of the present disclosure.
Figure 16:
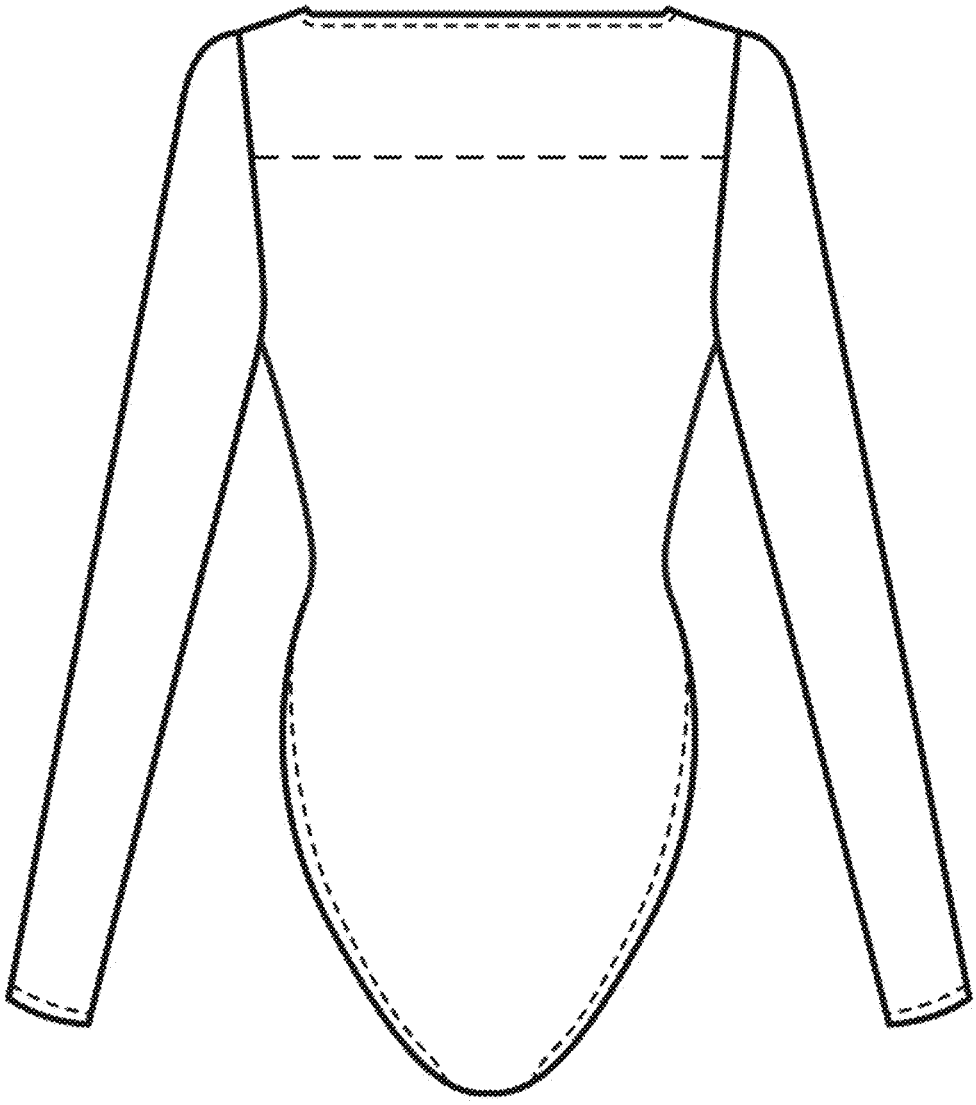
FIG. 16 illustrates a rear view of the magnetically securing clothing garment shown in FIG. 15.
Figure 17:
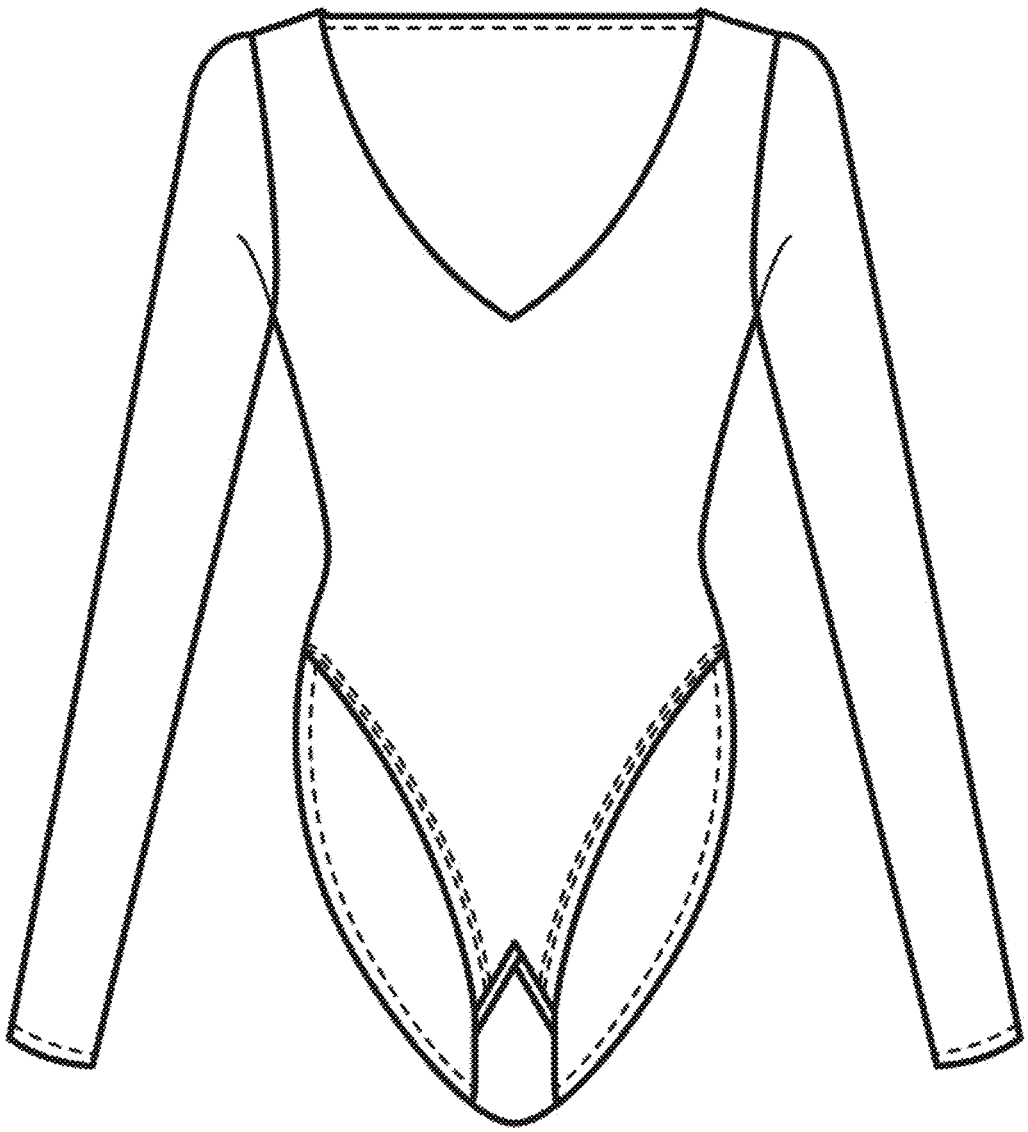
FIG. 17 illustrates a front view of a magnetically securing clothing garment according to another embodiment of the present disclosure.

In further embodiments, the lower back strap may comprise a second back strap end. In some embodiments, the second back strap end may comprise a first securing means. In some embodiments, the first securing means may be embedded in the second back strap end. In further embodiments, the first securing means may be rectangular, triangular, arrow shaped, curved, and/or any other type of shape. FIGS. 15 and 17 illustrate embodiments comprising triangular or arrow shaped closures. As shown in FIG. 15, the closure and/or clasp may be configured to open upwards by using the point of the arrow shaped closure to pull the garment strap up and away from the other garment strap portion when in the closed position.

In other implementations, the closure and/or clasp may be configured to open downwards. For example, as shown in FIG. 17, the wearer may pull the strap down by using the point or apex of the arrow shaped closure to pull the garment strap down and away from the other garment strap or portion.

Advantageously, some implementations of the closures and garment configurations disclosed herein can be operated or otherwise opened using one hand or even one finger, despite using magnets with a pull strength of at least 100 kg when coupled together in the closure. For example, and without limitation, the user may pull the apex of the arrow-shaped closure to open. To this end, the closures configuration disclosed herein can allow a user to leverage the clasp body, i.e., the arrow legs, to separate or open the two-part closure.

In yet further embodiments, the first securing means may comprise a plurality of securing means. In still further embodiments, the first securing means may be made from at least one of the following:

a. a zipper;
b. a magnetic material;
c. a button fastener;
d. a snap button fastener; and
e. a Velcro securing means.

In further embodiments, the first securing means may be configured to releasably connect to a second securing means at the pubic mound of the user of the garment. In some embodiments, when the first securing means is connected to the second securing means, the crotch area of the user of the garment may be substantially covered. In yet further embodiments, the lower back strap may be substantially longer in length than a front strap, if included on the garment.

D. Front Strap

Figure 18:
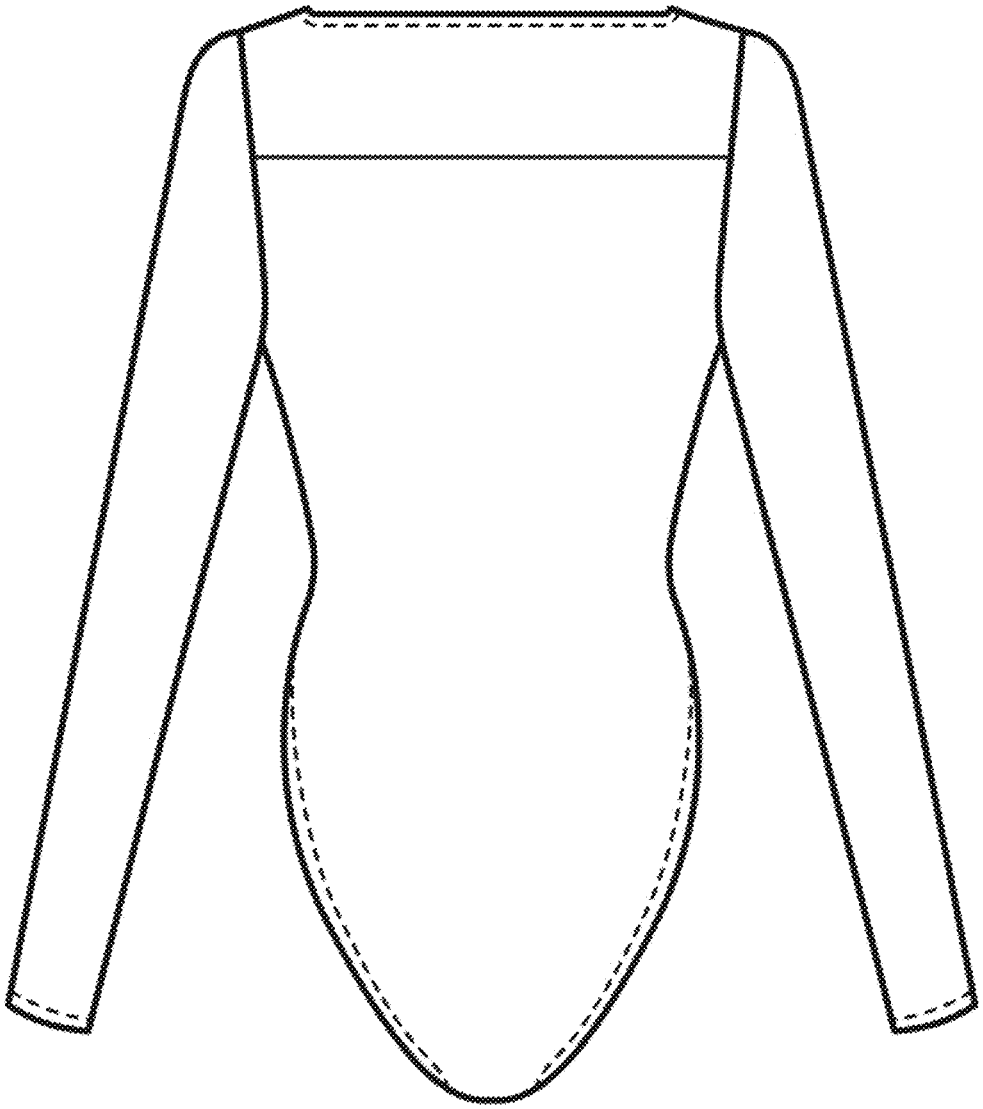
FIG. 18 illustrates a rear view of the magnetically securing clothing garment shown in FIG. 17.
Figure 19:
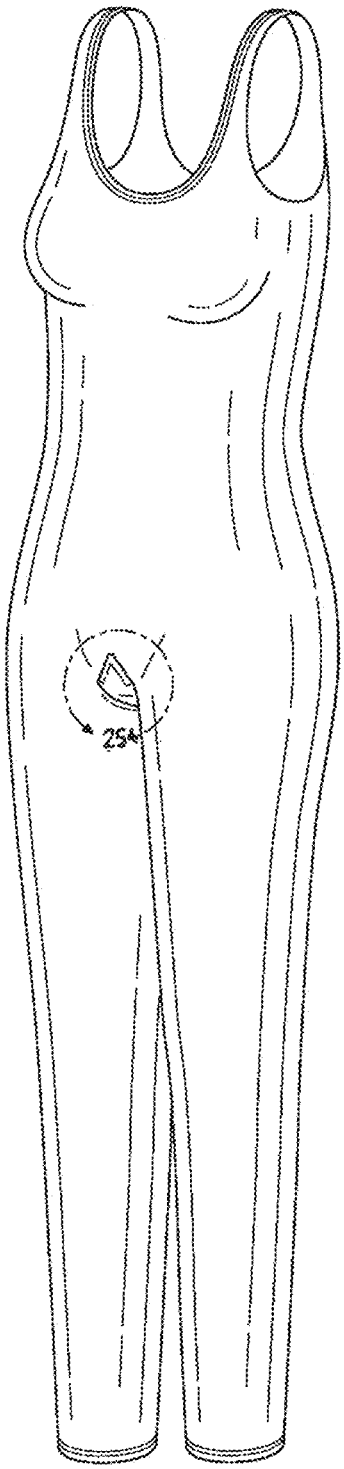
FIG. 19 illustrates a front perspective view of a clothing garment with a magnetically securable strap in a closed position according to another embodiment of the present disclosure.
Figure 20:
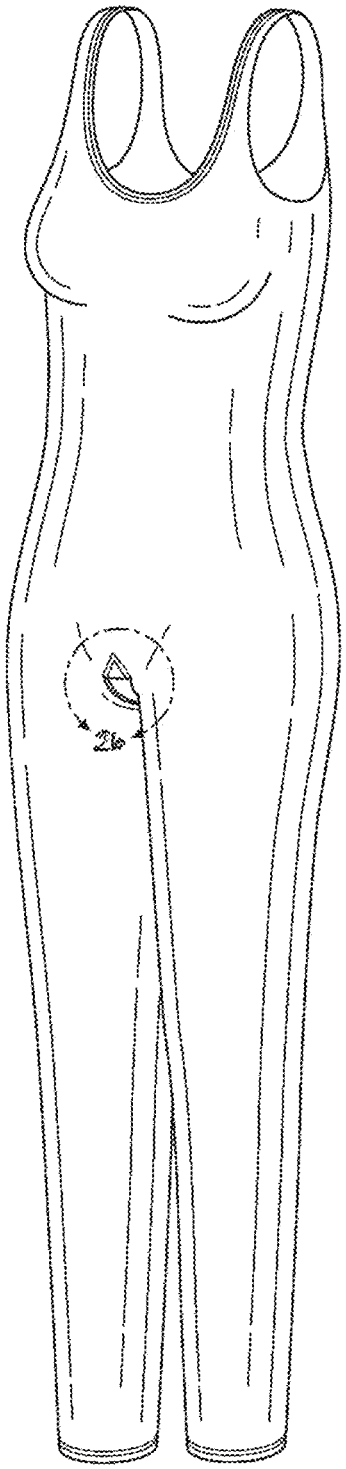
FIG. 20 illustrates a front perspective view of the garment shown in FIG. 19 with the strap in the open position.
Figure 21:
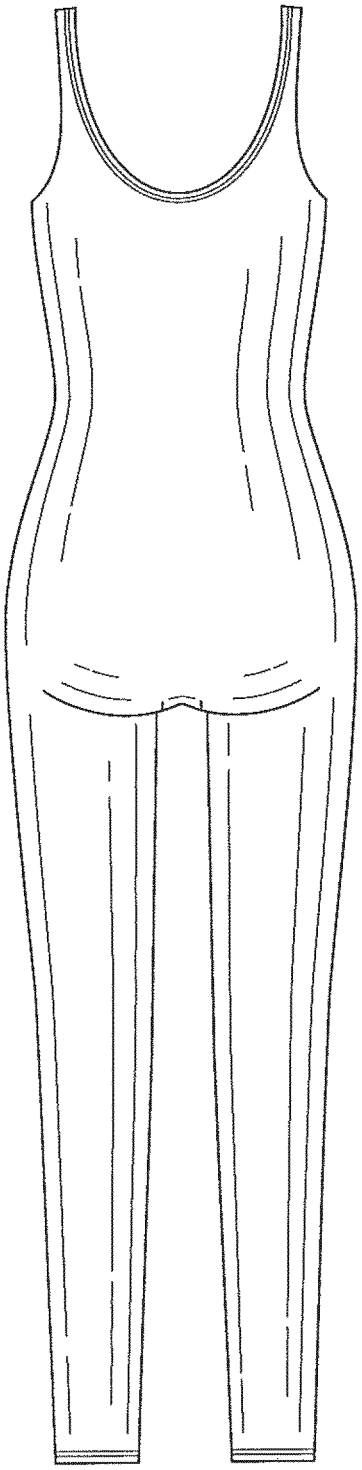
FIG. 21 illustrates a rear view of the garment shown in FIG. 19 with the strap in the closed position.
Figure 22:
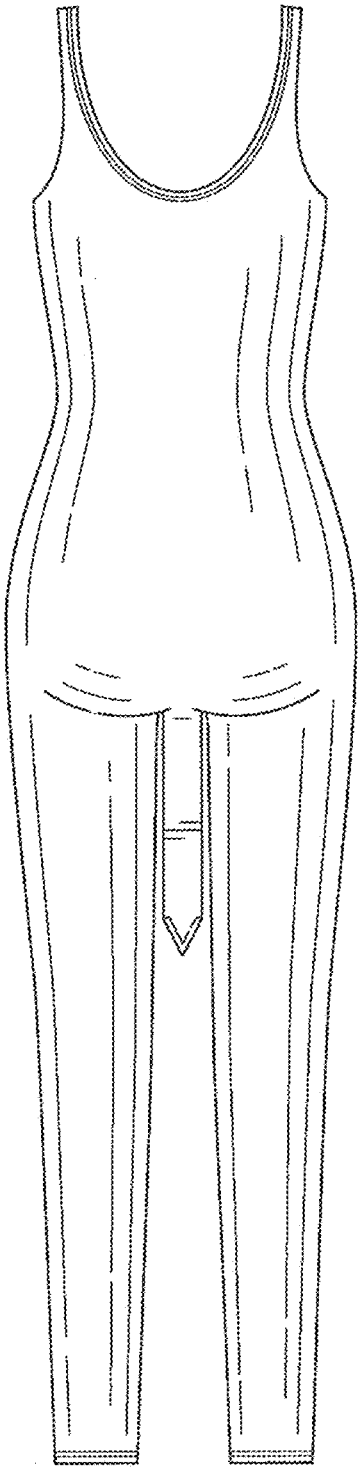
FIG. 22 illustrates a rear view of the garment shown in FIG. 20 with the strap in the open position.
Figure 23:
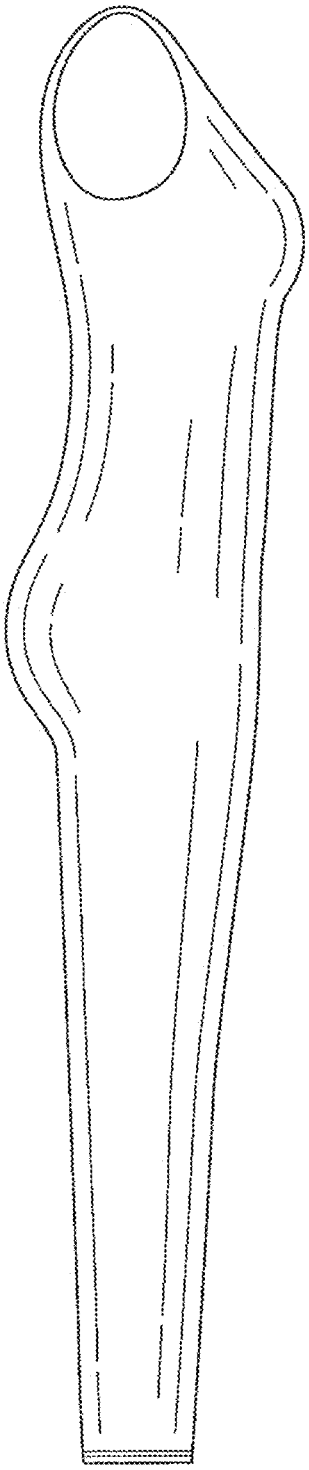
FIG. 23 illustrates a left side view of the garment shown in FIG. 19 with the strap in the closed position, wherein the right side view is a mirror image thereof.
Figure 24:
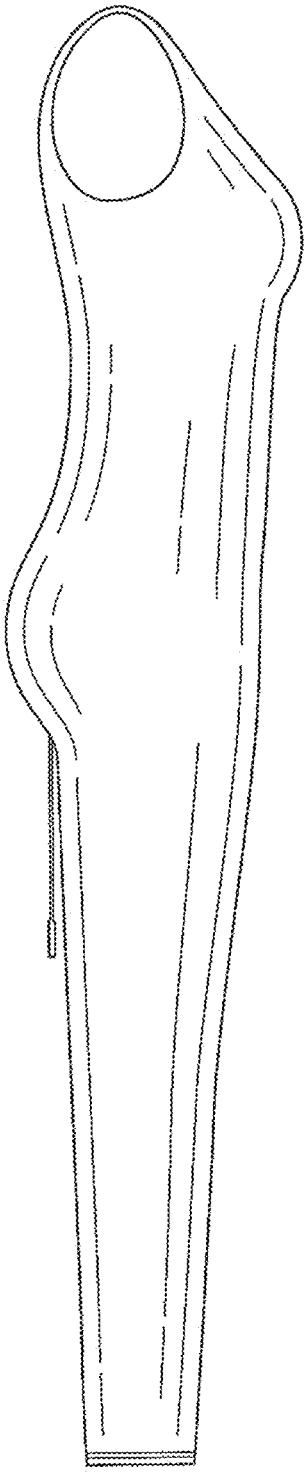
FIG. 24 illustrates a left side view of the garment shown in FIG. 20 with the strap in the open position, wherein the right side view is a mirror image thereof.
Figure 25:
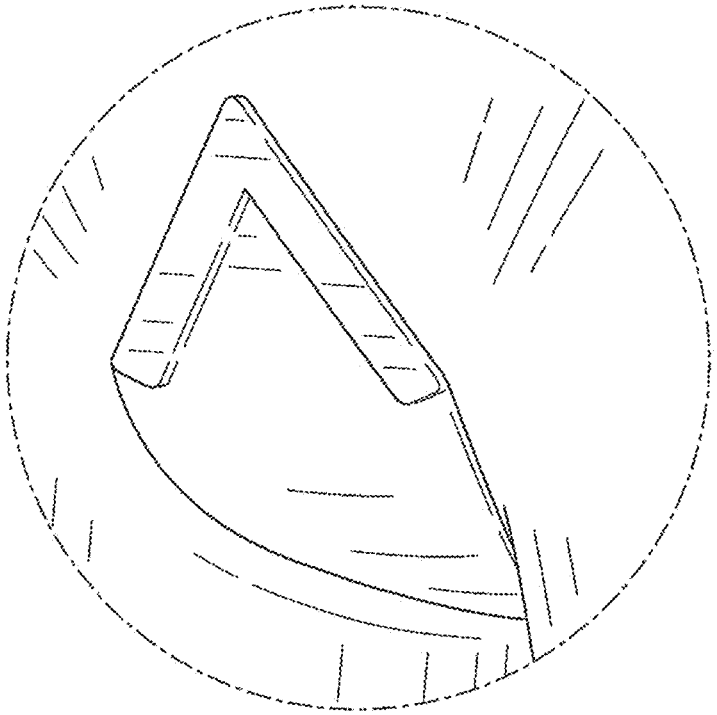
FIG. 25 illustrates a detailed view of the encircled portion 25 shown in FIG. 19.
Figure 26:
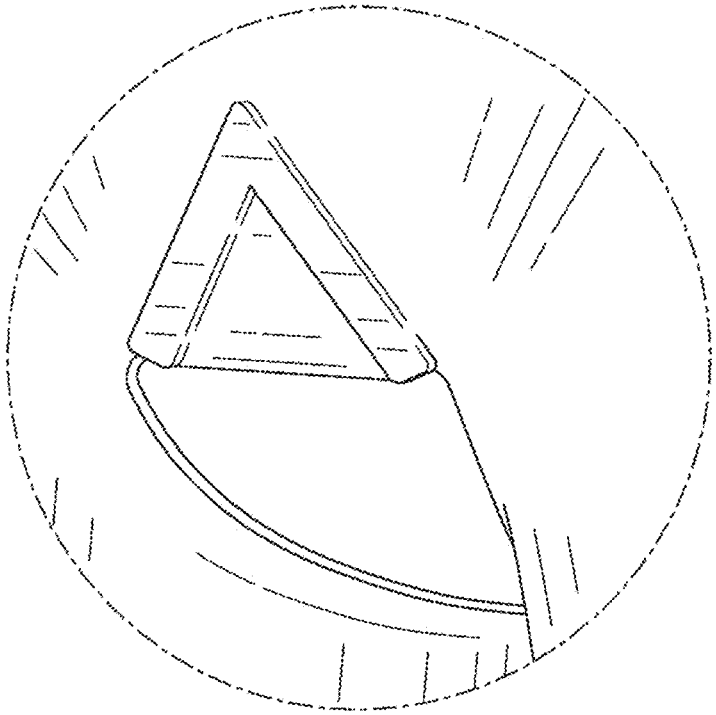
FIG. 26 illustrates a detailed view of the encircled portion 26 shown in FIG. 20.

FIGS. 17-18 illustrate a front strap or front flap consistent with an embodiment of the present disclosure. The front strap or front flap may be configured to close on top of the garment body.

In some embodiments, the front strap may comprise a first front strap end. In some embodiments, the first front strap end may be configured to connect to the front lower portion. In further embodiments, the front strap may comprise a second front strap end. In some embodiments, the second front strap end may comprise the second securing means. In some embodiments, the second securing means may be embedded in the second front strap end. In further embodiments, the second securing means may be configured to releasably connect to the first securing means between the legs of the user of the garment. In yet further embodiments, the second securing means may be rectangular, arrow shaped, curved, and/or any other type of shape. In still further embodiments, the second securing means may comprise a plurality of securing means. In even further embodiments, the second securing means may be made from at least one of the following:

a. a zipper;
b. a magnetic material;
c. a button fastener;
d. a snap button fastener; and
e. a Velcro securing means.

E. Plurality of Arm Apertures

According to various embodiments, the figures illustrate a plurality of arm apertures. In some embodiments, the plurality of arm apertures may be located between the front upper portion and the back upper portion. In further embodiments, the plurality of arm apertures may be configured to accommodate at least a part of an arm.

F. Collar Portion

According to various embodiments, the Figures illustrate a collar portion consistent with an embodiment of the present disclosure. In some embodiments, the collar portion may connect to the upper aperture. The collar portion may be used to accommodate the neck of the user of the garment. In other embodiments, the garment may be made from one or more layers of fabrics. By way of nonlimiting example, the garment may use multiple layers of fabrics to provide an increased level of comfort and warmth to the user of the garment. In further embodiments, multiple layers of the same fabric type may be used to form the garment.

In still further embodiments, multiple layers of different types of fabrics may be used in order to provide different functionalities. By way of nonlimiting example, an inner layer may be configured to be in contact with the skin of a wearer to be moisture absorbent. By further way of nonlimiting example, an outer layer configured to be exposed to the environment may be water repellent. As a result, the skin of wearer may be kept substantially dry by absorbing sweat and by not allowing water from the environment to come in contact with the skin. As a further result, a comfort level of the wearer may be greatly increased. In yet further embodiments, the fabric used to form the garment may be breathable.

III. Apparatus/System Use

Embodiments of the present disclosure provide a system operative by a set of methods comprising instructions configured to operate the aforementioned components in accordance with the methods. The following depicts an example of a method of a plurality of methods that may be performed by at least one of the aforementioned components. Various hardware components may be used at the various stages of operations disclosed with reference to each component.

For example, although methods may be described to be performed by a single component, it should be understood that, in some embodiments, different operations may be performed by different components in operative relation with one another. For example, an apparatus may be employed in the performance of some or all of the stages disclosed with regard to the methods. As such, the apparatus may comprise at least one architectural component disclosed herein.

Furthermore, although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed without altering or deterring from the fundamental scope of the depicted methods and systems disclosed herein.

Consistent with embodiments of the present disclosure, a method may be performed by at least one of the aforementioned components. The method may be embodied as, for example, but not limited to, instructions, which when executed, perform the method. The method may comprise the following stages:

1. A method for assembling a magnetically securing clothing garment, the method comprising:
2. providing a torso portion comprising:
   a. providing a front lower portion,
   b. providing a front upper portion,
   c. providing a back lower portion, and
   d. providing a back upper portion;
3. connecting a first back strap portion of a back strap to the back lower portion, the back strap being substantially longer in length than a front strap;
4. connecting a first front strap portion of a front strap to the lower front portion;
5. connecting a second back strap portion of the back strap embedded with a securing means to a second front strap portion of the front strap embedded with a securing means at the pubic mound area of the user; and
6. covering, when the second back strap portion and the second front portion are connected, the crotch area of a user of the garment via the back strap and the front strap.

Although the stages are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed without altering or deterring from the fundamental scope of the depicted methods and systems disclosed herein.

The following disclose various Aspects of the present disclosure. The various Aspects are not to be construed as patent claims unless the language of the Aspect appears as a patent claim. The Aspects describe various non-limiting embodiments of the present disclosure.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The invention claimed is:

1. A magnetically securing clothing garment comprising:

a lower torso portion configured to be worn over a lower torso of a user, the lower torso portion comprising:

a front portion, a back portion; and a strap portion configured to couple the back portion and the front portion, the strap portion being fixed to one of the back portion or the front portion at one end of the strap and free at the other end of the strap, the free end configured for being removably coupled to the other of the front portion or back portion, wherein the strap portion is configured for being circumferentially disposed over the pubis mound of the user and between legs of the user, and when coupled to the back and front portions, the strap portion and the front and back portions define leg apertures, each leg aperture configured for allowing passage therethrough of a leg of the user wearing the garment, wherein the strap portion comprises a first magnetic fastener coupled to the free end of the strap portion and the other of the front portion or back portion to which the strap portion is removably coupled comprises a second magnetic, fastener, wherein each of the first and second magnetic fasteners comprise magnetic material arranged in a V-shape; and wherein the first magnetic fastener and the second magnetic fastener have a pull strength of at least 100 kg when the first magnetic fastener and the second magnetic fastener are coupled together without fabric.

2. The garment of claim 1, wherein the V-shape of the magnetic material has an apex, and the apex extends in a superior direction of the garment relative to opposite ends of a closure formed when the first and second magnetic fasteners are coupled.

3. The garment of claim 1, wherein the fixed end of the strap portion is coupled to the back portion of the lower torso portion and the free end of the strap portion is releasably couplable to the front portion of the lower torso portion.

4. The garment of claim 1, wherein the first and second magnetic fasteners are configured for being disposed adjacent the pubic mound of the user when the garment is worn and the fasteners are coupled to form a closure.

5. The garment of claim 1, wherein each magnetic fastener comprises a plurality of magnets.

6. The garment of claim 5, wherein the plurality of magnets of the first magnetic fastener are disposed within a first pocket formed in the garment, and the plurality of magnets of the second magnetic fastener are disposed within a second pocket formed in the garment.

7. The garment of claim 6, wherein the plurality of magnets of each fastener are coupled to a flexible substrate, the plurality of magnets being articulatable relative to each other, wherein adjacent magnets of the first magnetic fastener abut each other, and wherein adjacent magnets of the second magnetic fastener abut each other.

8. The garment of claim 5, wherein the plurality of magnets of each fastener are coupled to a flexible substrate, the plurality of magnets being articulatable relative to each other, wherein adjacent magnets of the first magnetic fastener abut each other, and wherein adjacent magnets of the second magnetic fastener abut each other.

9. The garment of claim 1, further comprising an upper torso portion having an upper front portion and an upper rear portion that are integrally formed with the front portion and the back portion, respectively, of the lower torso portion.

10. The garment of claim 9, wherein the upper torso portion defines a neck aperture between an upper edge of the upper front portion and the upper rear portion, said neck aperture configured to allow passage of a neck and a head of the user wearing the garment, and the upper torso portion defines arm apertures between the upper front portion and the upper rear portion, each arm aperture being configured to allow passage of an arm of the user wearing the garment.

11. The garment of claim 10, further comprising a collar portion coupled to the neck aperture.

12. The garment of claim 11, further comprising sleeves coupled to the respective arm apertures.

13. The garment of claim 10, further comprising sleeves coupled to the respective arm apertures.

14. The garment of claim 1, further comprising pant legs coupled to the respective leg apertures, each pant leg configured for extending at least partially along a thigh of the user when the user dons the garment.

* * * * *